US008814950B2

(12) United States Patent
Somasundaran et al.

(10) Patent No.: US 8,814,950 B2
(45) Date of Patent: Aug. 26, 2014

(54) DETERGENT COMPOSITIONS UTILIZING HYDROPHOBICALLY MODIFIED POLYMER

(75) Inventors: Ponisseril Somasundaran, Nyack, NY (US); Yajuan Li, Shanghai (CN)

(73) Assignee: The Trustees of Columbia University in the City of New York, New York, NY (US)

( * ) Notice: Subject to any disclaimer, the term of this patent is extended or adjusted under 35 U.S.C. 154(b) by 211 days.

(21) Appl. No.: 13/129,433

(22) PCT Filed: Nov. 17, 2009

(86) PCT No.: PCT/US2009/064830

§ 371 (c)(1),
(2), (4) Date: Jul. 11, 2011

(87) PCT Pub. No.: WO2010/057202

PCT Pub. Date: May 20, 2010

(65) Prior Publication Data

US 2011/0259361 A1 Oct. 27, 2011

Related U.S. Application Data

(60) Provisional application No. 61/199,482, filed on Nov. 17, 2008.

(51) Int. Cl.

| | |
|---|---|
| ***C11D 3/37*** | (2006.01) |
| ***D06L 1/02*** | (2006.01) |
| ***C11D 3/20*** | (2006.01) |

(52) U.S. Cl.
USPC ..... 8/137; 510/276; 510/281; 510/383; 510/361

(58) Field of Classification Search
None
See application file for complete search history.

(56) References Cited

U.S. PATENT DOCUMENTS

| | | | | |
|---|---|---|---|---|
| 3,803,068 | A | 4/1974 | Mestetsky et al. | |
| 5,021,525 | A | 6/1991 | Montague et al. | |
| 5,346,726 | A | 9/1994 | Pechhold | |
| 5,747,442 | A * | 5/1998 | Bory et al. | 510/475 |
| 5,820,637 | A * | 10/1998 | Bory et al. | 8/137 |
| 2003/0114331 | A1 * | 6/2003 | Baker et al. | 510/276 |
| 2004/0063597 | A1 | 4/2004 | Adair et al. | |
| 2007/0241306 | A1 * | 10/2007 | Wehner et al. | 252/67 |

FOREIGN PATENT DOCUMENTS

WO WO-2010057202 A1 5/2010

OTHER PUBLICATIONS

Qui et al., Intramolecular Association of Poly(maleic acid/octyl vinyl ether) in Aqueous Solution, vol. 18, pp. 5921-5924 and 5926.*
"European Application Serial No. 09826984.8, Supplementary European Search Report mailed Jun. 4, 2012", 5 pgs.
"International Application Serial No. PCT/US2009/064830, Search Report mailed Jan. 15, 2010", 2 pgs.
"International Application Serial No. PCT/US2009/064830, Written Opinion mailed Jan. 15, 2010", 6 pgs.

(Continued)

*Primary Examiner* — Nicole Blan
(74) *Attorney, Agent, or Firm* — Schwegman Lundberg & Woesser, P.A.

(57) ABSTRACT

Embodiments of the invention relate to a detergent composition including a poly(maleic acid/vinyl octyl ether) (PMAOVE) hydrophobically modified polymer; and a heavy duty liquid detergent. In addition, embodiments relate to a method of cleaning a substrate, including contacting a substrate with a poly(maleic acid/vinyl octyl ether) (PMAOVE) hydrophobically modified polymer solution.

14 Claims, 36 Drawing Sheets

(56) References Cited

OTHER PUBLICATIONS

Qui, et al., ""Intramolecular Association of Poly(malelc acld/octyl vinyl ether) in Aqueous Solut ion."", vol. 18, . especially p. 5921, col. 1, para p. 5922'-col. 1 , para 2; p. 5926, col. 1, para 2, (Jun. 22, 2002), 5921-5926.

European Application Serial No. 09826984.8, Response filed Nov. 22, 2012 to Extended Search Report mailed Jun. 6, 2012, 11 pgs.

* cited by examiner

DETERGENT COMPOSITIONS UTILIZING HYDROPHOBICALLY MODIFIED POLYMER

CROSS-REFERENCE TO RELATED PATENT APPLICATION

This patent application is a nationalization under 35 U.S.C. 371 of PCT/US2009/064830, filed Nov. 17, 2009 and published as WO 2010/057202 A1 on May 20, 2010, which claimed priority under 35 U.S.C. 119(e) to U.S. Patent Application Ser. No. 61/199,482, filed Nov. 17, 2008; which applications and publication are incorporated herein by reference in their entirety.

GOVERNMENT SPONSORSHIP

This invention was made with government support under NSF-EEC 0328614 awarded by the National Science Foundation. The government has certain rights in the invention.

BACKGROUND

Heavy-duty liquid (HDL) detergents used for stain removal on fabric surfaces represented a $2.9 billion market in the United States in 2007. Industry trends towards formulation of premium products with scents, detergent/fabric softener combinations, specific stain-type targeting, etc. suggest an opportunity for introduction of additional new formulations that improve product performance.

The major factors that affect the washing performance of Heavy-Duty Liquid (HDL) laundry detergents are soap concentration, nature of active ingredients in the soap, nature of stains, water hardness, and temperature. If all other factors—soils, water hardness, and temperature—are held constant, the cleaning performance is a function of the concentration, the type of active ingredients, and the mode of delivery into the cleaning bath. Oily stains are water-insoluble organic liquids. Incorporation of the oily stains into surfactant micelles is one way to solubilize the insoluble substance. Since solubilizing the oily stains requires micelles or similar supramolecular structures, the concentration of the surfactant in water must exceed the critical micelle concentration, even after the adsorption of the surfactant on the fabric has taken place. Calculations have shown that the concentrations of surfactants used in practical laundering do not exceed micelles the critical micelle concentration to solubilize oily stains. Consequently, it is difficult for a general HDL formulation to remove all types of undesirable materials from different substrates.

BRIEF DESCRIPTION OF THE DRAWINGS

In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

OVERVIEW

Embodiments relate to a detergent composition including a poly(maleic acid/vinyl octyl ether) (PMAOVE) hydrophobically modified polymer; and a heavy duty liquid detergent. In addition, embodiments relate to a method of cleaning a substrate, including contacting a substrate with a poly(maleic acid/vinyl octyl ether) (PMAOVE) hydrophobically modified polymer solution.

DETAILED DESCRIPTION

Embodiments of the invention relate to detergent compositions including hydrophobically modified polymers (HM-polymer). The HM-polymer exhibit the behavior of both polymers as well as surfactants. Embodiments of the present invention provide a hydrophobically modified polymer (e.g., poly(maleic acid/vinyl octyl ether) (PMAOVE)), as a stain specific surfactant capable of solubilizing oily stains. The embodiments demonstrate superior ability to remove both fresh and aged oily stains from fabric after short washing times. The polymer may be incorporated as an additive to HDL detergent formulations.

Due to the associative nature of the hydrophobic groups in aqueous solutions, HM-polymers with sufficient hydrophobic groups can form intra-molecular nanodomains at all concentration and intermolecular domains at high concentrations. An oily stain may interact with HM-polymers due to electrostatic and hydrophobic forces. Moreover, some of the HM-polymers have the ability to interact with both the hydrophobic and hydrophilic groups. The presence of both hydrophobic and hydrophilic groups on the polymer backbone provides them with the ability to form two different kinds of nanodomains. Due to this ability, the polymers can be utilized to remove different kinds of stains at the same time.

Figure 1:
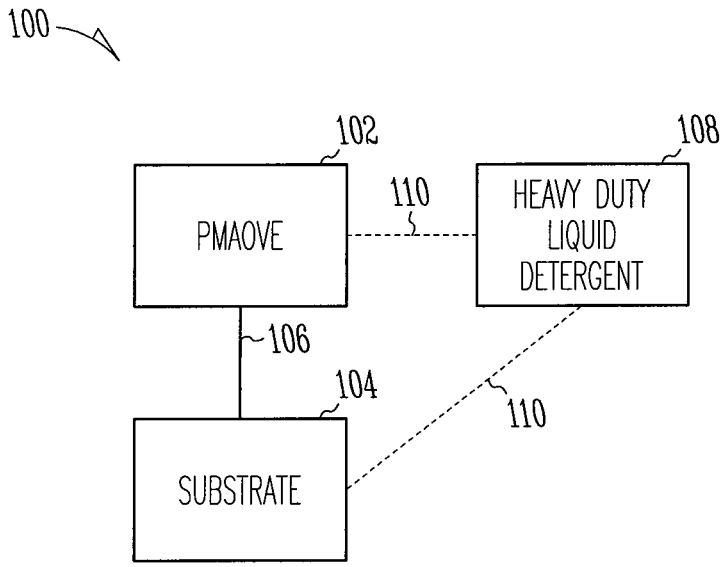
FIG. 1 illustrates a block flow diagram of a method of cleaning a substrate, according to some embodiments.

Referring to FIG. 1, a block flow diagram 100 of a method of cleaning a substrate is shown, according to some embodiments. A hydrophobically modified polymer (PMAOVE) 102, may be contacted 106 with a substrate 104, sufficient to at least partially remove a stain. A heavy duty liquid detergent 108 may be optionally contacted 110 with the PMAOVE, either before or after contacting 106 the substrate. The solution or substrate may be agitated. Agitation may include shaking, mixing, spinning, rotating, vibrating or pressing, for example. Agitation may occur in a washing machine or may be the result of a user pressing a "pre-spotter" apparatus including the PMAOVE to a stain on a substrate.

The PMAOVE hydrophobically modified polymer 102 may have monomers of the following structure:

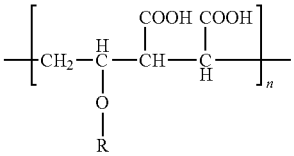

where R is an octyl chain. The amount of PMAOVE in a solution with a heavy duty liquid detergent 108 may be about 1-10%, about 5-25%, about 25-75% or about 60-99%, for example.

The substrate 104 may be fabrics, such as clothing fabrics. Clothing fabrics may include wool, silk, plant textiles, mineral textiles, polyester, aramid, acrylic, nylon, spandex, olefin fiber, polylactide fiber, metallic fibers or combinations thereof.

A heavy duty liquid detergent 108 may include, among other things, one or more surfactants and one or more polymers. The surfactants function to clean the substrate and the one or more polymers assist in maintaining the stability of the detergent. The heavy duty liquid detergent 108 may include about 10-20% surfactant, about 15-45% surfactant or about 20-85% surfactant for example. Stains may include oily compositions, such as oleic acid. Stains are often caused by the presence of water-insoluble organic liquids.

EXAMPLES

Characterization Using UV

Figure 2A:
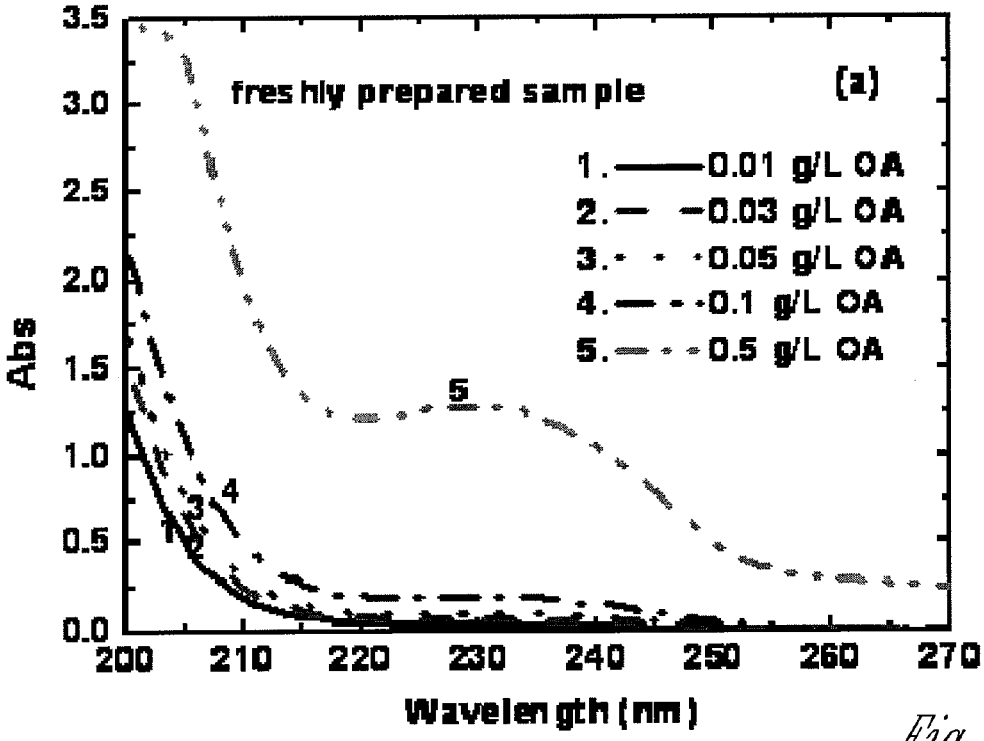
FIGS. 2A-B illustrate graphical views of UV absorbance of a series of oleic acid concentrations, according to some embodiments.
Figure 2B:
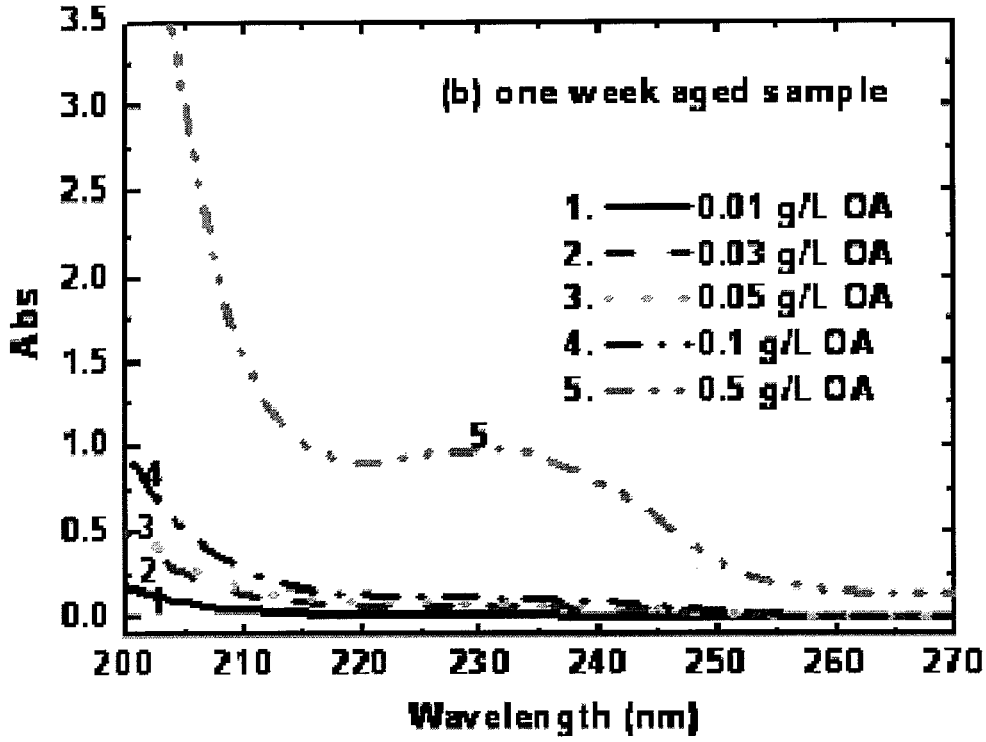

The double bond of oleic acid in solution may get oxidized when the acid is exposed to ambient air. UV was used in this example to detect how quickly the acid ages when it is exposed. FIGS. 2A-B show the UV absorbance of a series of oleic acid concentrations for the freshly prepared solutions and one week aged solutions. It can be seen that the relative ratios of 200 nm to 240 nm for freshly prepared solutions and aged solutions are different. This may be due to the degradation of the oleic acid solutions (see FIGS. 2A-B). UV absorption spectra of oleic acid at pH 11 are shown for freshly prepared solution 2A and aged oleic acid solution 2B.

Figure 3:
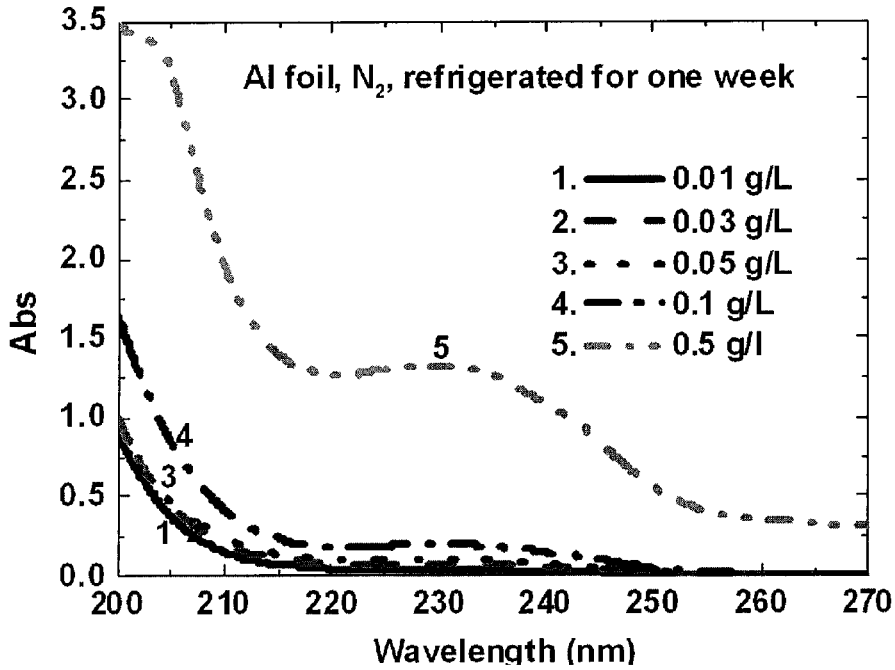
FIG. 3 illustrates a graphical view of the UV response of oleic acid solutions, according to some embodiments.

FIG. 3 represents the UV response of oleic acid solutions that were refrigerated with nitrogen at pH 11. It can be seen that the UV response of freshly prepared solution is similar to that of solution kept under nitrogen, which may suggest that nitrogen can aid in avoiding the oxidization of the double bond. Therefore, oleic acid solution either may be kept under nitrogen to avoid oxidation or it may be prepared freshly for every set of experiments. UV was also used to study the interaction between oleic acid and PMAOVE. The UV absorbance by PMAOVE may mask the absorbance of oleic acid.

Characterization Using Acid Value Titration:

In order to monitor the saturation binding of oleic acid in the presence of polymer, acid value titration was performed to determine the oleic acid concentration without the polymer. The experimental and the calculated results are given in Table 1. From Table 1, it is shown that the experimental results are close to the calculated values at higher oleic acid concentrations. The minimum oleic acid concentration tested by acid value titration is 1 g/L.

TABLE 1

The calculated and experimental oleic acid concentration.

| sample | NaOH (10 mM) | concentration (g/L) |
|---|---|---|
| 0.01 g/L | pink | |
| 0.1 g/L | 0.22 mL | 0.06 g/L |
| 1 g/L | 3.60 mL | 1.02 g/L |
| 2 g/L | 7.00 mL | 1.98 g/L |
| 5 g/L | 9.00 mL | 5.08 g/L |

Figure 4:
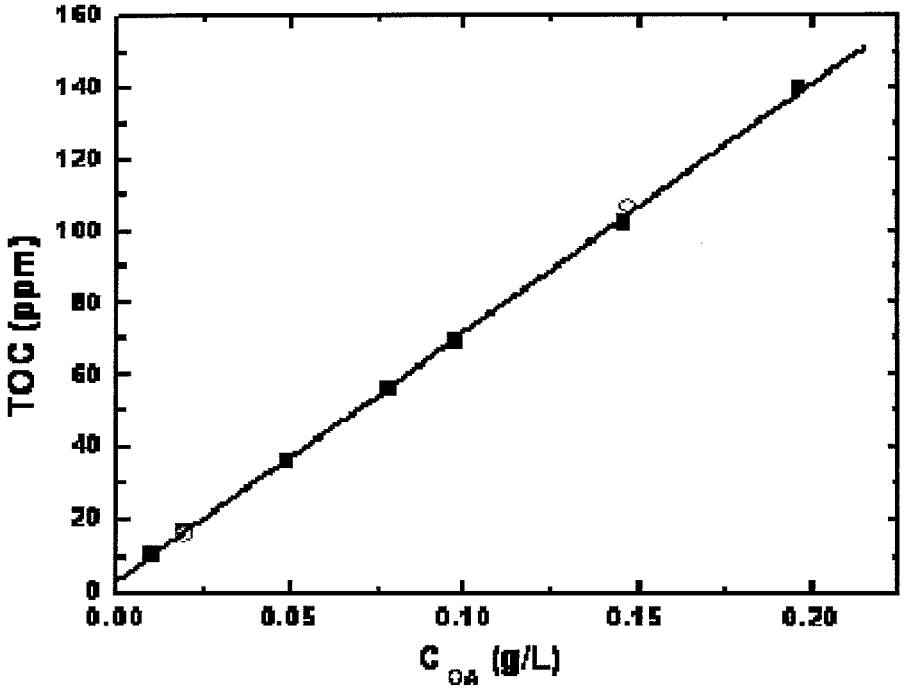
FIG. 4 illustrates a graphical view of the dependence of carbon content from TOC on oleic acid concentration, according to some embodiments.

Characterization Using Total Organic Carbon (TOC):

From the above acid value titration results, it may be seen that the acid value titration can be used to identify oleic acid at higher concentration (>1 g/L). Because of the lower stain concentration (10 g/60 L $H_2O$), total organic carbon (TOC) was next tested to determine the oleic acid concentration. FIG. 4 shows the dependence of carbon content from TOC on the oleic acid concentration. As shown, a linear profile is obtained. The minimum oleic acid concentration tested by acid value titration is 0.01 g/L. For determining the oleic acid concentration, the sensitivity of TOC is higher than that of acid value titration.

Figure 5:
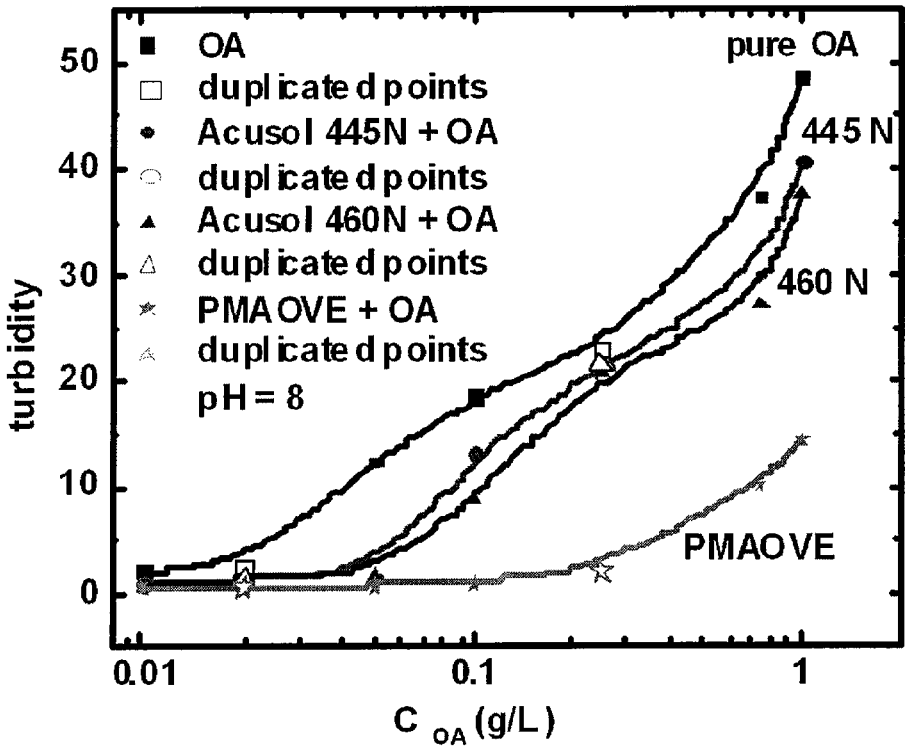
FIG. 5 illustrates a graphical view of turbidity results at a fixed polymer concentration, according to some embodiments.

Solubilization of Oleic Acid by Surface Active Reagents (Acusol 445N, Acusol 460 N, Commercial HDL, and PMAOVE); PMAOVE vs Acusol Polymers (Acusol 445N, Acusol 460N):

Turbidity of the solutions was used as a metric to study the solubility of stain in reagents. The turbidimetry results at a fixed polymer concentration of 1000 ppm at pH 8 are shown in FIG. 5. The structure of the Acusol polymers was studied by H-NMR and the properties were investigated by fluorescence. It is to be noted that the lower the turbidity, the higher the solubilization and thus the removal of oleic acid. Furthermore, the turbidity of the mixed polymer and oleic acid solutions is lower than that of a pure oleic acid, indicating that polymers can be used to increase the solubilization of oleic acid in aqueous solution. Compared to the turbidities of oleic acid solution, the turbidities of mixed solutions of Acusol polymers and oleic acid are slightly lower. However, the turbidities of the mixed PMAOVE and oleic acid solutions show a marked reduction. These results suggest that PMAOVE is more effective at increasing the solubilization of oleic acid than Acusol polymers. Turbidity of the mixed polymer (1000 ppm) and oleic acid solutions is shown as a function of oleic acid concentration at pH 8 (see FIG. 5).

Figure 6:
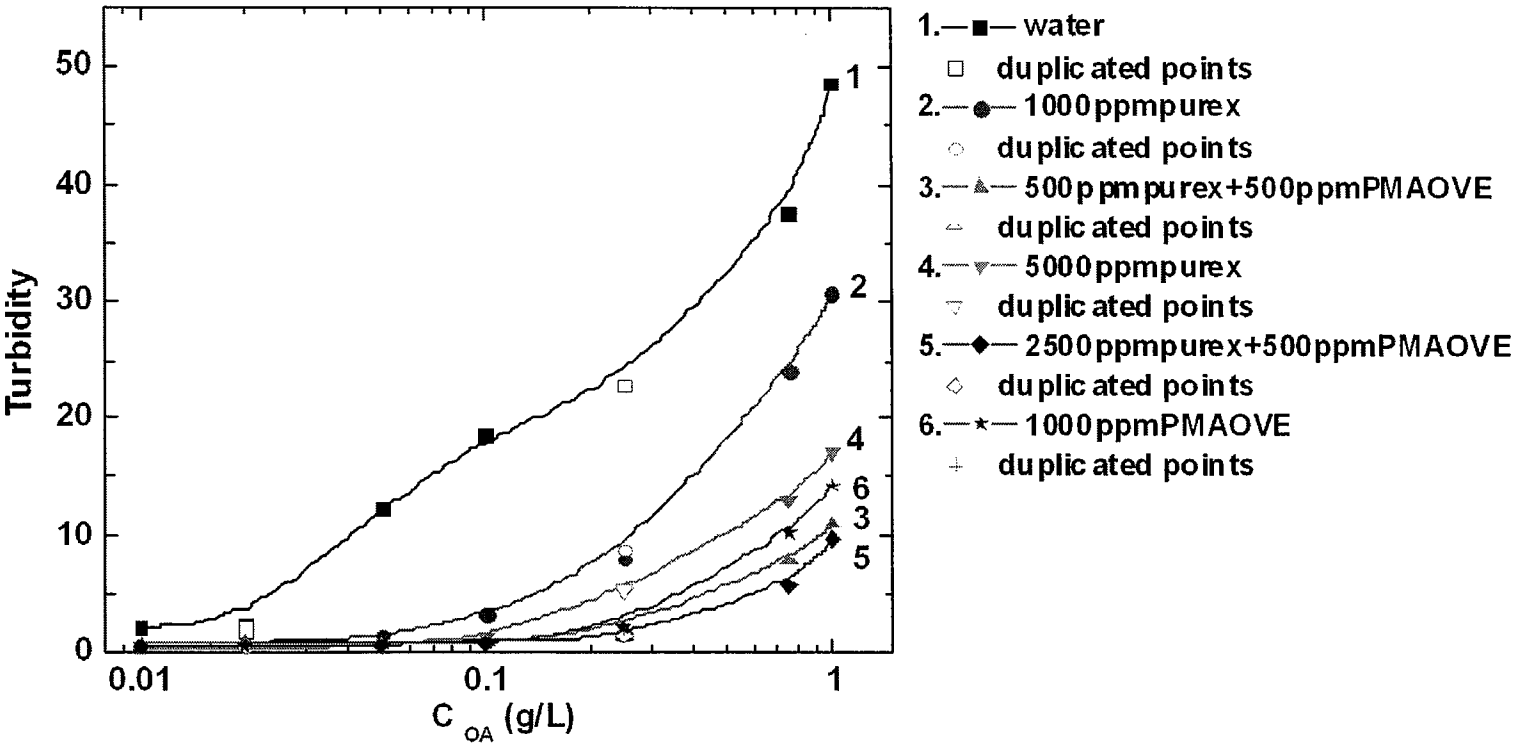
FIG. 6 illustrates a graphical view of turbidity results at fixed reagent concentrations, according to some embodiments.
Figure 7A:
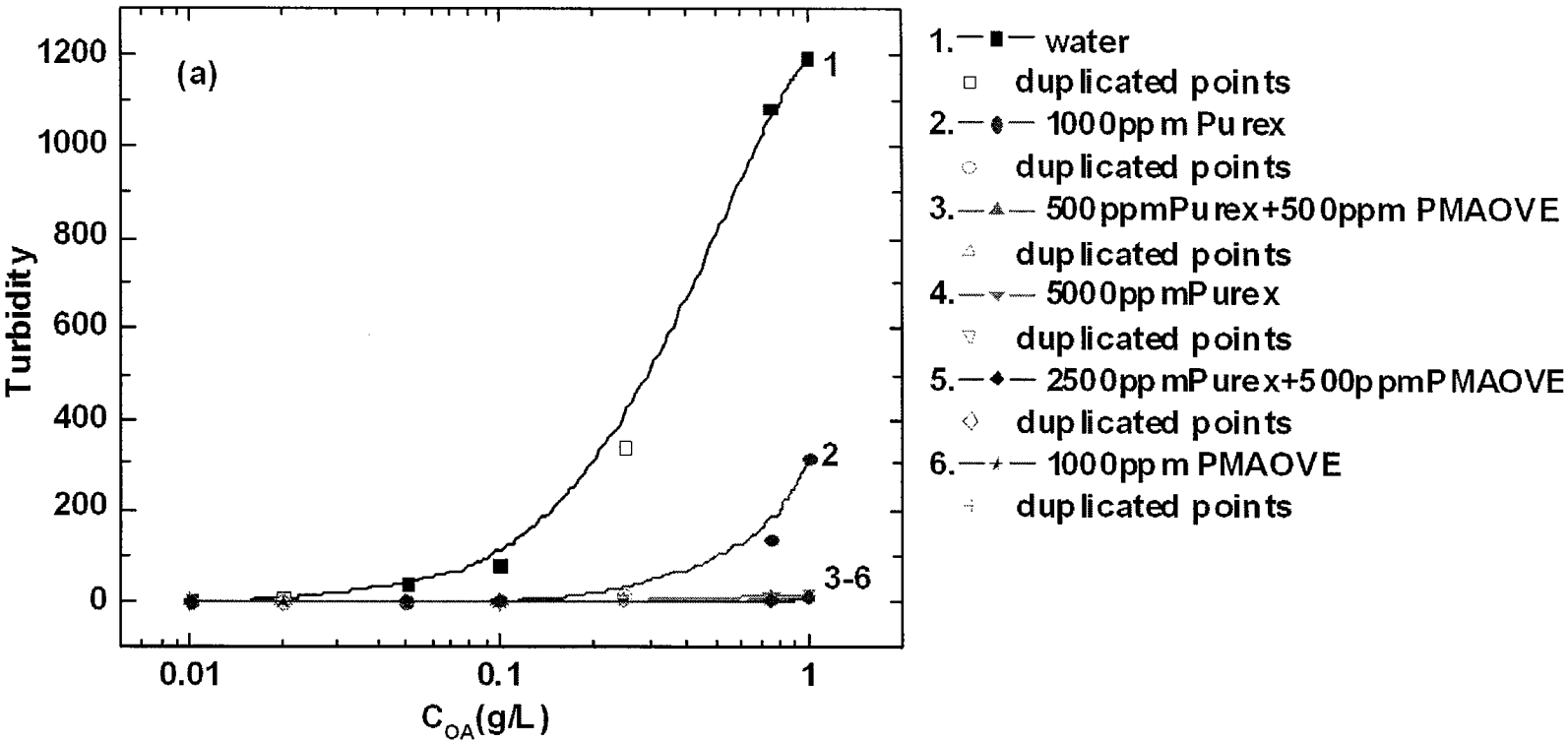
FIGS. 7A-B illustrate a graphical views of turbidity results of the mixed reagent and aged oleic acid solutions, according to some embodiments.
Figure 7B:
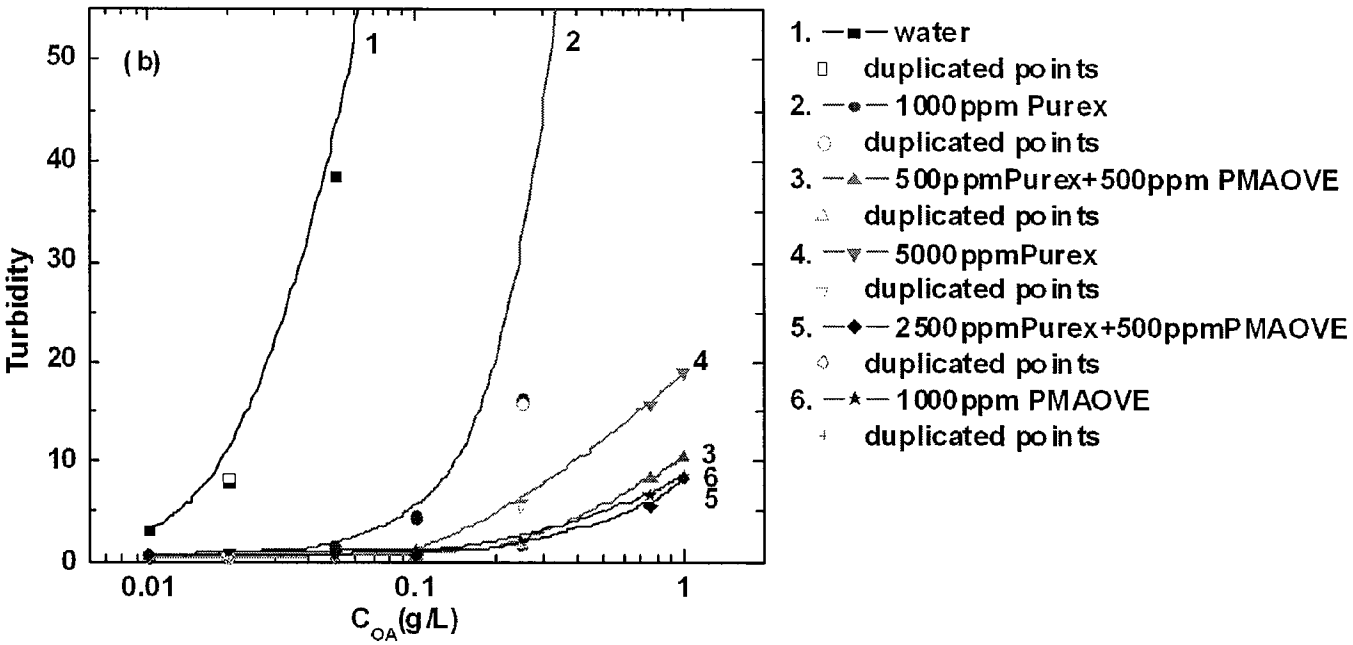

PMAOVE vs Commercial HDL Detergents:

The turbidimetric results at fixed reagent concentrations (1000 ppm, or 5000 ppm) for dissolving fresh oleic acid at pH 8 are shown in FIG. 6. It can be seen that the turbidity of the mixed reagent (HDL, PMAOVE, and HDL/PMAOVE) and oleic acid solutions is lower than that of a solutions containing oleic acid alone, indicating that the above reagents can be used to solubilize oleic acid. Moreover, the turbidity of PMAOVE (1000 ppm)/oleic acid mixed solutions is lower than that of HDL (1000 ppm)/oleic acid mixed solutions. Assuming that the content of the HDL detergent is 80% water, in order to get the same amount of surface active reagent in HDL as 1000 ppm PMAOVE, 5000 ppm HDL was used to solubilize the oleic acid. Even in this case, the turbidity of PMAOVE (1000 ppm)/oleic acid mixed solution is lower than that of the HDL (5000 ppm)/oleic acid mixed solution. This suggests that PMAOVE is more effective in dissolving oleic acid in solution than of the HDL mixture. Moreover, it should be noted that the turbidity of PMAOVE/HDL/oleic acid mixed solution is the lowest, which means that the mixture of PMAOVE and HDL is more effective in dissolving the oleic acid in solution than pure PMAOVE or pure HDL possibly due to synergistic effects. So, the effectiveness of the tested reagents to solubilize the fresh oleic acid under the tested conditions can be stated to follow the order of HDL/PMAOVE>PMAOVE>HDL. Next solubilization of aged oleic acid was also tested. The turbidimetric results at fixed reagent concentrations (1000 ppm, or 5000 ppm) for dissolving the aged oleic acid at pH 8 are shown in FIGS. 7A-B. In the case of aged oleic acid also, we found the solubilization effect to follow the same sequence: HDL/PMAOVE>PMAOVE>HDL. Turbidity of the mixed reagent and aged oleic acid solutions is shown as a function of oleic acid concentration at pH 8. (a) the full scale graph; (b) the zoom in of the graph (see FIGS. 7A-B).

Figure 8:
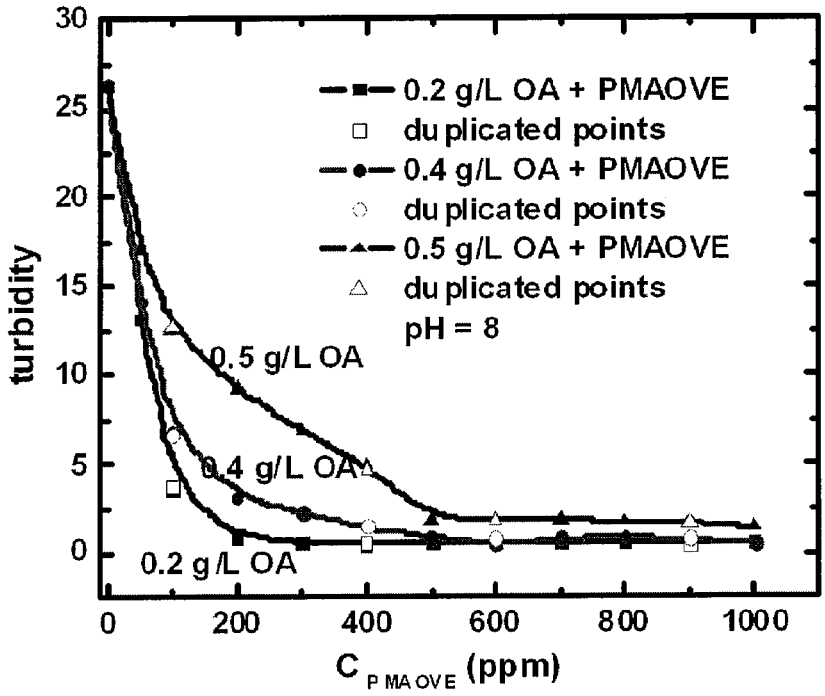
FIG. 8 illustrates a graphical view of turbidity results at fixed oleic acid concentrations, according to some embodiments.

In the above experiments, the PMAOVE concentration was fixed at 1000 ppm and the oleic acid concentration was varied from 0.01 g/L to 1 g/L. The detergent concentration in real washing condition differs for different users. Therefore, the effect of polymer concentration on the solubilization of oleic acid was next studied, at fixed oleic acid concentrations of 0.2, 0.4, and 0.5 g/L. As shown in FIG. 8, at polymer concentrations lower than 500 ppm, the turbidity of the mixed PMAOVE and oleic acid solutions increases with increase in oleic acid concentration, indicating that not all of the added oleic acid is dissolved in the polymer solution below 500 ppm. However, it should be noted that the oleic acid concentrations are higher than the typical concentrations of stain in the washing machine.

When the polymer concentration higher is than 500 ppm, the turbidities of the mixed PMAOVE and oleic acid solutions are almost constant. This suggests that oleic acid in the tested concentration range could be completely incorporated into the polymer hydrophobic domains above 500 ppm PMAOVE solution. Turbidity of the mixed PMAOVE and oleic acid (0.2, 0.4, and 0.5 g/L) solutions is shown as a function of polymer concentration at pH 8 (see FIG. 8).

Figure 9A:
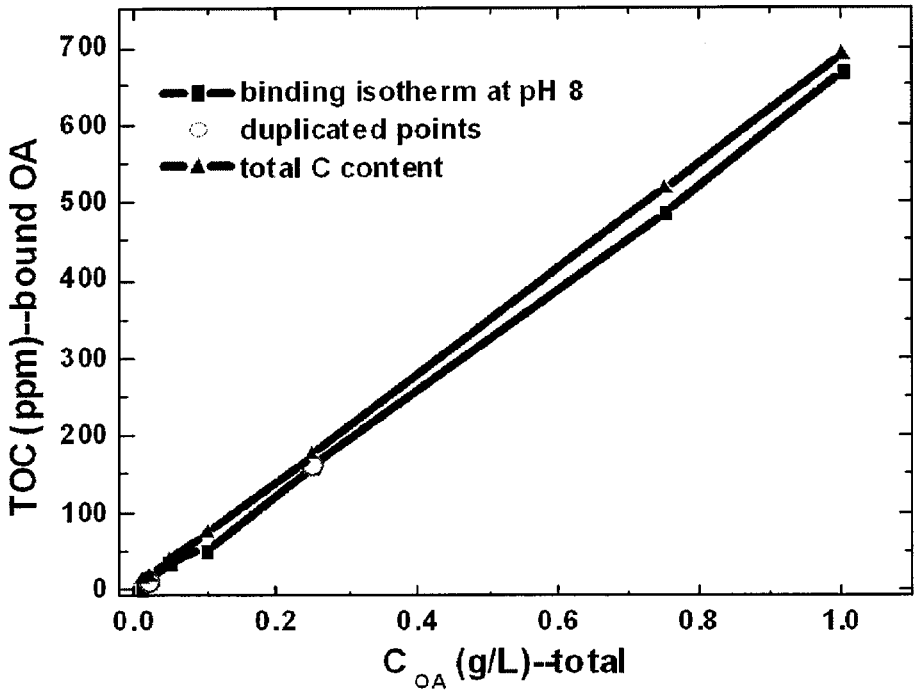
FIGS. 9A-B illustrate graphical views of the binding isotherm of oleic acid in relation to concentration of PMAOVE, according to some embodiments.
Figure 9B:
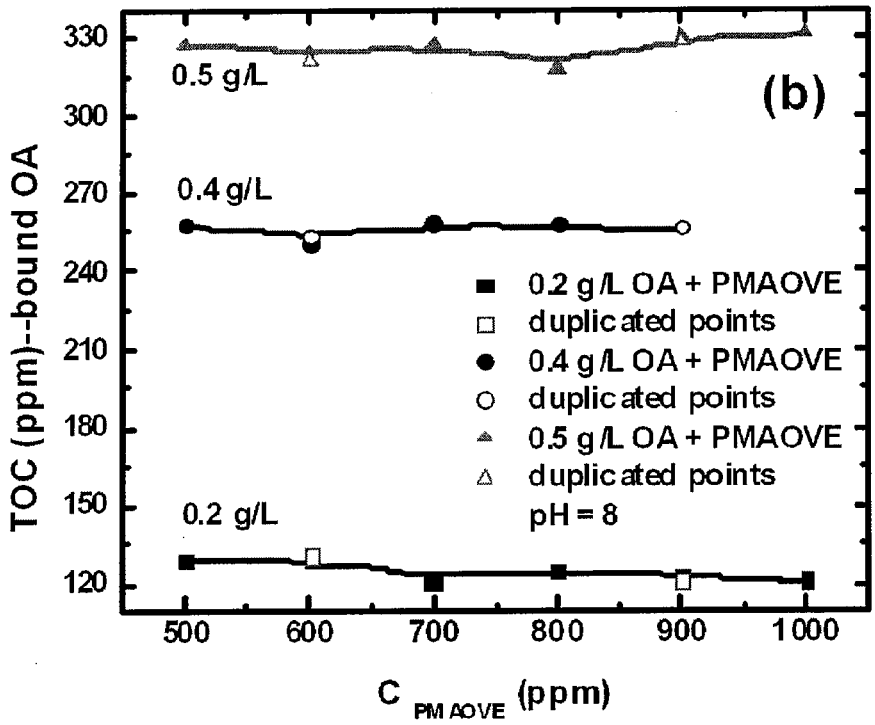

Binding Isotherm of Oleic Acid and PMAOVE at pH 8:

The binding isotherms of oleic acid on surface active agents are very important because it may indicate which surface active reagent is effective in dissolving oleic acid in solution. To obtain the binding isotherms, the unbound oleic acid was separated using ultrafiltration with a membrane filter of cutoff 50,000 MW (note that MW of PMAOVE is ~160,000). Filtration process was optimized to remove the organics completely from the filter by soaking the membrane overnight (See appendix). TOC was used to monitor the unbound oleic acid concentration. By combining TOC and filtration, the binding isotherm of oleic acid and PMAOVE at pH 8 is obtained and displayed in FIGS. 9A-B. As shown in FIGS. 9A-B, at a fixed PMAOVE concentration of 1000 ppm (a), the concentration of bound oleic acid increases with increase in the oleic acid concentration in solution. It is important to note that the total oleic acid concentration is almost the same in the presence of the bound oleic acid concentration, indicating that almost all of the added oleic acid was bound to the polymer. The constant difference may be due to losses during the experiments.

At fixed oleic acid concentrations (b), the concentration of bound stains does not change with the polymer concentration. This indicates that as little as 500 ppm polymer dose is enough to bind the tested oleic acid amounts. The binding isotherm of oleic acid to PMAOVE at pH 8 is shown: (a): at fixed polymer concentration (1000 ppm); (b) at fixed oleic acid concentration (0.2 g/L, 0.4 g/L, and 0.5 g/L) (see FIGS. 9A-B).

Figure 10:
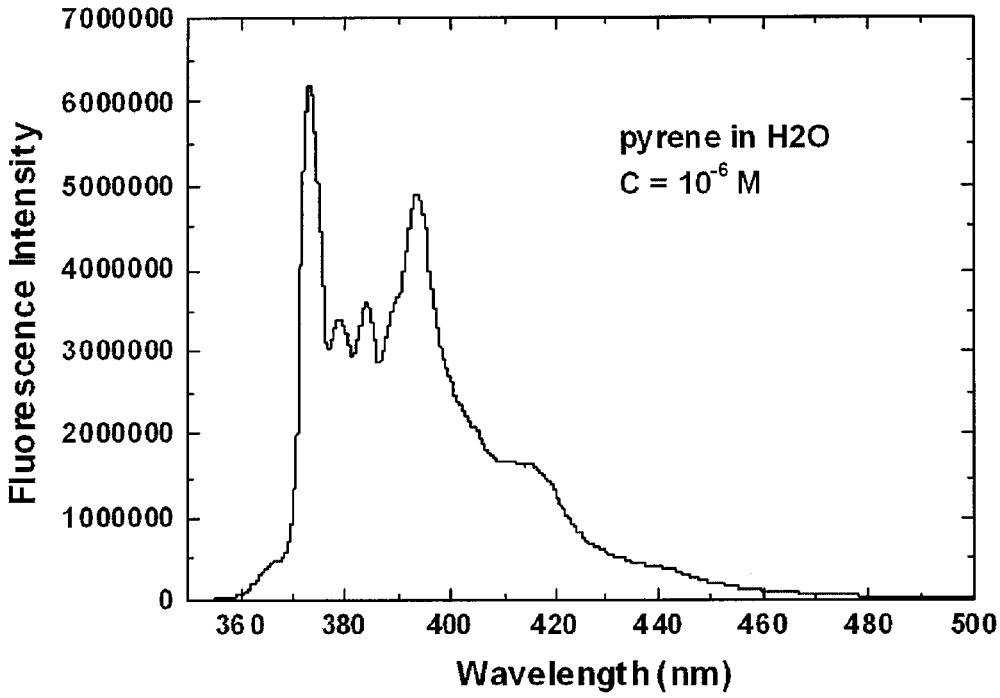
FIG. 10 illustrates a graphical view of a pyrene fluorescence spectrum, according to some embodiments.
Figure 11:
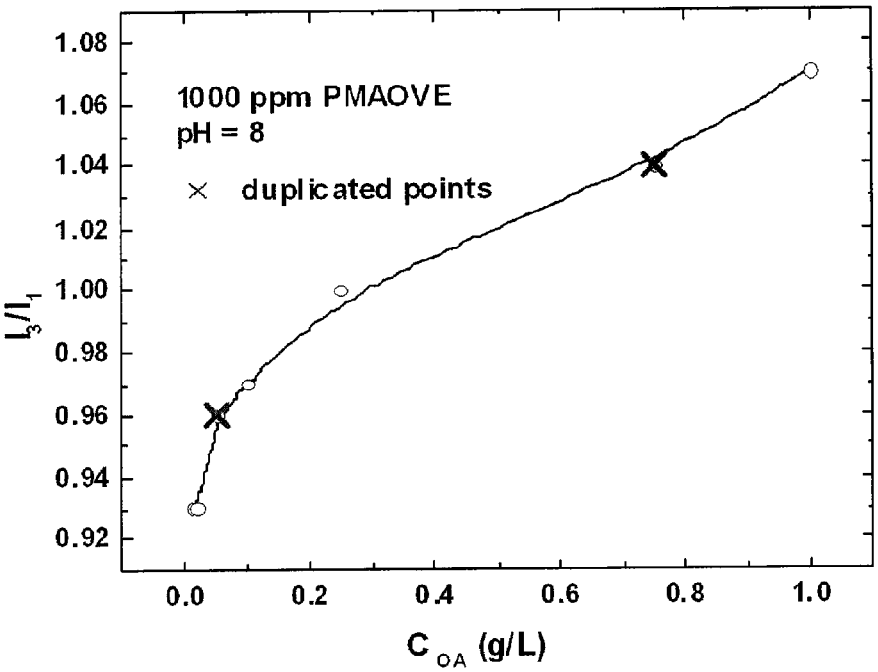
FIG. 11 illustrates a graphical view of the dependence of binding isotherm of mixtures of oleic acid to PMAOVE, according to some embodiments.
Figure 12:
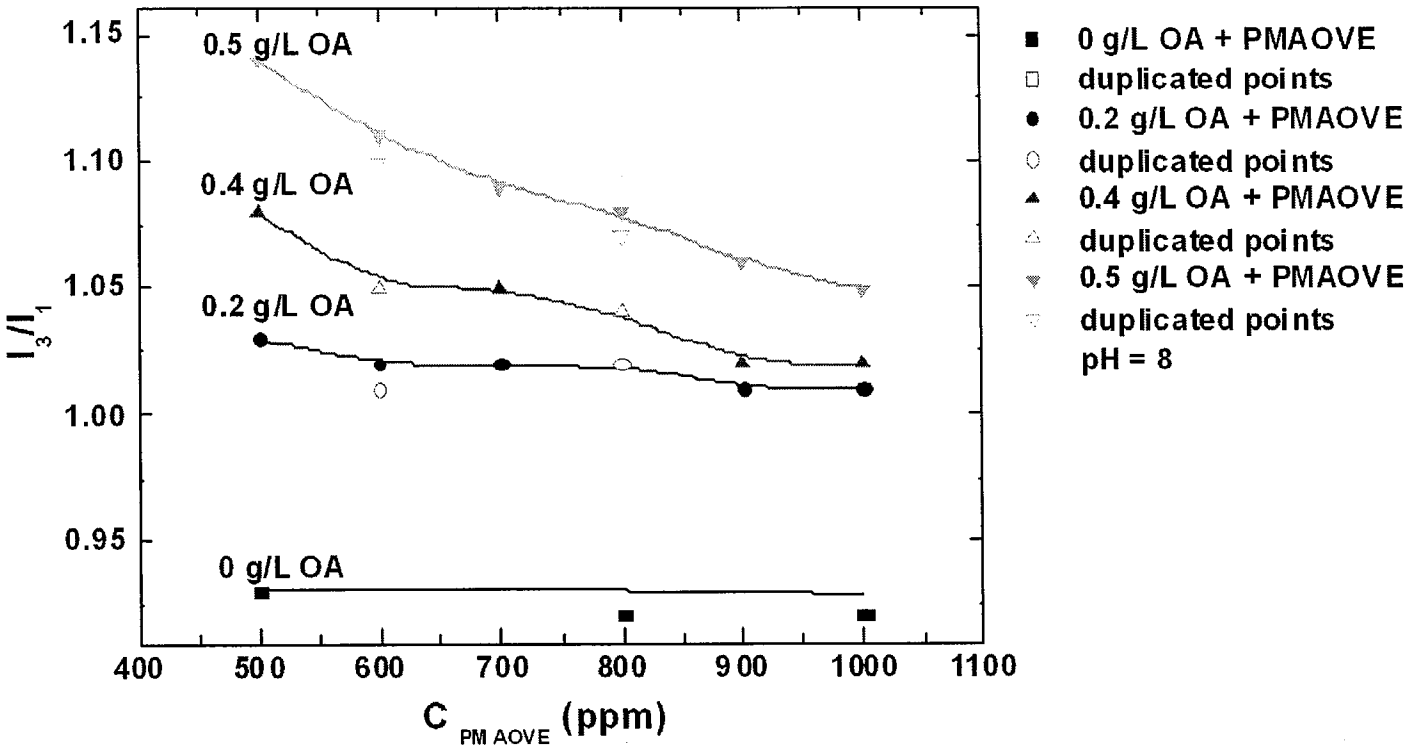
FIG. 12 illustrates a graphical view of the variation of pyrene polarity ratio with PMAOVE concentration, according to some embodiments.

Mechanism of the Interactions Between Oleic Acid and PMAOVE:

In order to elucidate the mechanisms of interactions of stain molecules and polymers, fluorescence spectroscopy was used with pyrene ($10^{-6}$ M) as a probe to monitor the hydrophobic domains from measurements of the pyrene polarity index $I_3/I_1$, which is the ratio of the intensity of the third to the first vibronic peak in the fluorescence spectrum. A typical pyrene fluorescence spectrum is presented in FIG. 10. Pyrene was excited at 335 nm and the emission spectra were scanned from 350 to 500 mm. FIG. 11 shows the dependence of the $I_3/I_1$ of the mixtures of oleic acid with 1000 ppm PMAOVE at pH 8 on the oleic acid concentration. With increasing $C_{OA}$, the $I_3/I_1$ increases sharply and then linearly, which arise from possible progressive incorporation of oleic acid molecules into PMAOVE hydrophobic aggregates. FIG. 12 presents the variation of pyrene polarity ratio $I_3/I_1$ with PMAOVE concentration. At fixed oleic acid concentration, the values of pyrene polarity ratio ($I_3/I_1$) decreases with increasing PMAOVE concentration, indicating that the micropolarity increases. Usually, the micelle-solubilized pyrene is located in the palisade layer of the micelle (Zana, R. In *Surfactant Solutions*. New Methods of Investigation, Zana, R., Ed.: Marcel Dekker: New York, 1987; pp 241-294). However, with an increasing PMAOVE concentration, the packing of alkyl chains becomes tighter and tighter. This tighter packing structure may bring the pyrene closer to the micelle surface. Such a change in pyrene solubilization, though minor, would cause an increase in micropolarity.

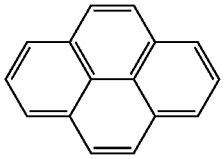

Chemical structure of pyrene.

Figure 13:
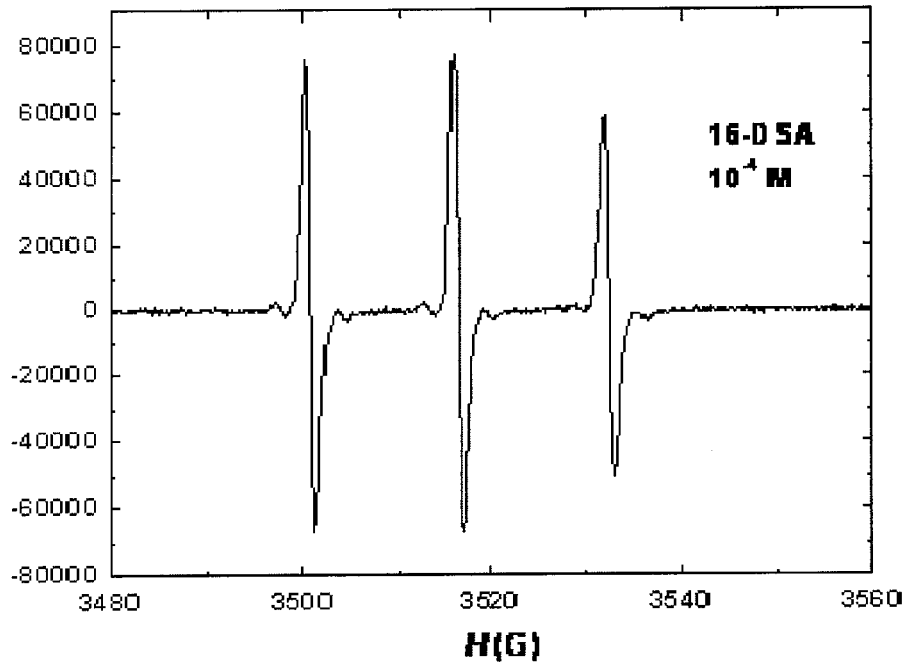
FIG. 13 illustrates a graphical view of an ESR spectrum, according to some embodiments.

In order to further study the mechanism of the interaction between oleic acid and PMAOVE, the ESR spectra of 16-DSA were recorded. FIG. 13 shows a typical ESR spectrum of 16-DSA in water. The following parameters can be obtained from these spectra:

Rotational correlation time ($\tau_c$):

The rotational correlation time $\tau_c$ is regarded as the time needed for a molecule to rotate an angle of $\pi$. Larger $\tau_c$ indicates larger motion restriction of the probe, i.e., a larger microviscosity experienced by the probe. The rotational correlation time $\tau_c$ can be calculated from ESR spectra following the equation:

$$\tau_c = (6.6\times10^{-10})W_0\left[\left(\frac{h_0}{h_{-1}}\right)^{1/2}+\left(\frac{h_0}{h_{+1}}\right)^{1/2}-2\right]$$

where $W_0$ represents the peak-to-peak line width of the ESR mid-field line (in gauss) and $h_{+1}$, $h_0$, and $h_{-1}$ are the peak-to-peak heights of the low-, mid-, and high-field lines, respectively.

Hyperfine splitting constant ($A_N$):

Higher hyperfine coupling constant $A_N$ due to a greater electron density at nitrogen suggests a more polar environment. The hyperfine coupling constant $A_N$ can be calculated from the ESR spectra following the equation:

$$A_N=(A_{\parallel}+2A_{\perp})/3$$

where $A_{\parallel}$ is the time-averaged electron-nuclear hyperfine tensor (parallel) and $A_{\perp}$ is the time-averaged electron nuclear hyperfine tensor (perpendicular). Higher hyperfine coupling constant $A_N$ due to a greater electron density at nitrogen suggests a more polar environment.

Figure 14A:
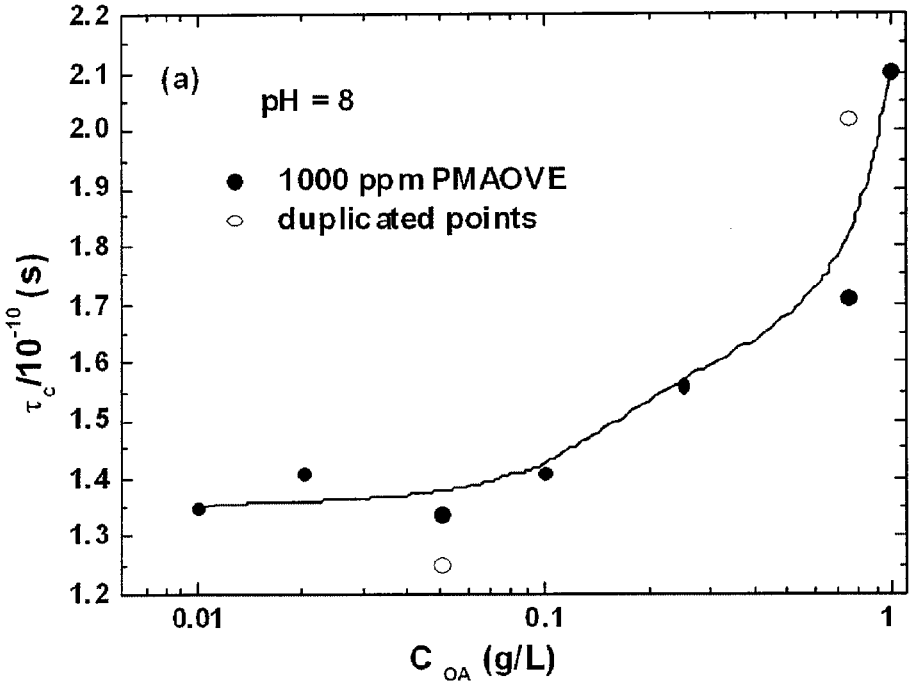
FIGS. 14A-B illustrate graphical views of variations of rotational correlation time ($\tau_c$) and hyperfine coupling constant ($A_N$) with oleic acid concentration for oleic acid/PMAOVE mixtures, according to some embodiments.
Figure 14B:
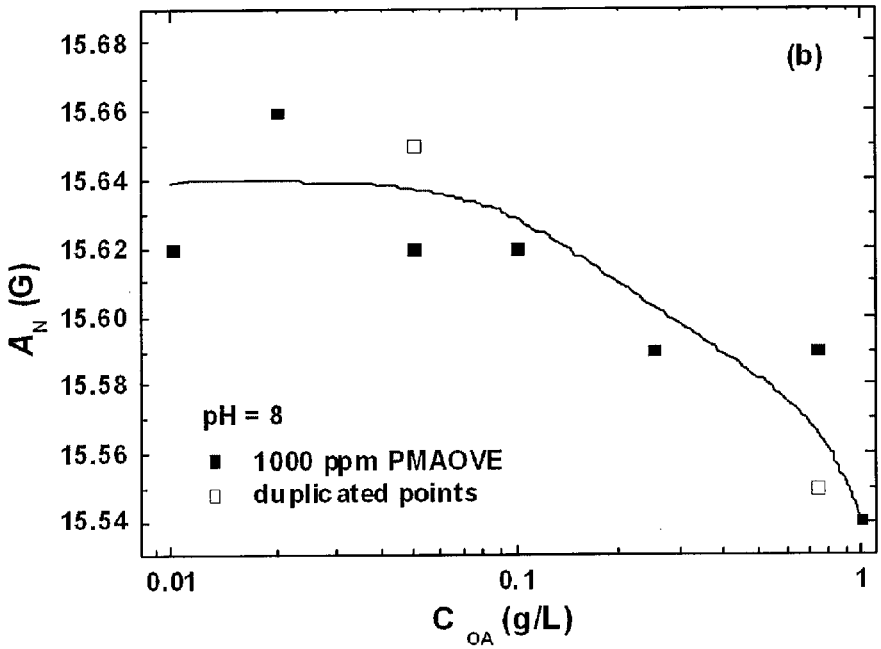

FIGS. 14A-B show the variations of (a) $\tau_c$ and (b) $A_N$ with oleic acid concentration for oleic acid/PMAOVE mixtures. The values of $\tau_c$ and $A_N$ are almost constant up to a concentration of 0.1 g/L. When oleic acid concentration is increased above 0.1 g/L, $\tau_c$ increases sharply, while $A_N$ decreases. This indicates that the mixed aggregates have a larger microviscosity and smaller micropolarity at higher $C_{OA}$. The incorporation of oleic acid reduces the electrostatic repulsion between the acid groups of PMAOVE. The alkyl chains aggregate tightly, leading to the formation of more compacted aggregates. On the other hand, the decrease in micropolarity suggests that there is very little water penetration into the interior of the hydrophobic core possibly because of the low solubility of the oleic acid molecules. The incorporation of oleic acid to PMAOVE may produce compact hydrophobic aggregates, leading to the increased $\tau_c$ and decreased $A_N$. It is noted that the ESR results in general support the above fluorescence results. FIGS. 14A-B shows the variation of $\tau_c$ and $A_N$ with PMAOVE concentration for oleic acid/PMAOVE aggregates. For oleic acid/PMAOVE aggregates, $\tau_c$ increases with increasing PMAOVE concentration while $A_N$ decreases gradually. This suggests that at higher PMAOVE concentration the oleic acid/PMAOVE aggregates have larger microviscosity and smaller micropolarity at the probe binding site. The alkyl chains of the probe possibly aggregate tightly with increasing PMAOVE concentration, leading to the formation of the more-closed packing oleic acid/PMAOVE aggregates. Such compacted hydrophobic aggregates would lead to the observed increase in $\tau_c$ and decrease in $A_N$. It is noted that the ESR results is different from the above fluorescence results possibly due to different location of the probe. As stated before, pyrene is initially located in the palisade layer and may be pushed out to surface of the aggregates at higher PMAOVE concentration. However, (Baglioni, P.; Dei, L.; Rivara-Minten, E.; Kevan, L. *J. Am. Chem. Soc.* 1993, 115, 4286), surfactant-like molecules of 16-DSA are readily incorporated into micelles. The acidic group is located at the micellar surface and the doxyl group is located at the deeper position of the headgroup region close to the hydrophobic core. The advantage of using different techniques to get information on a nanoscale is very clear.

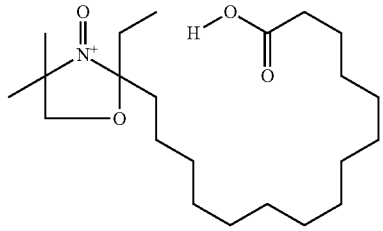

Chemical structure of 16-DSA.

Figure 15A:
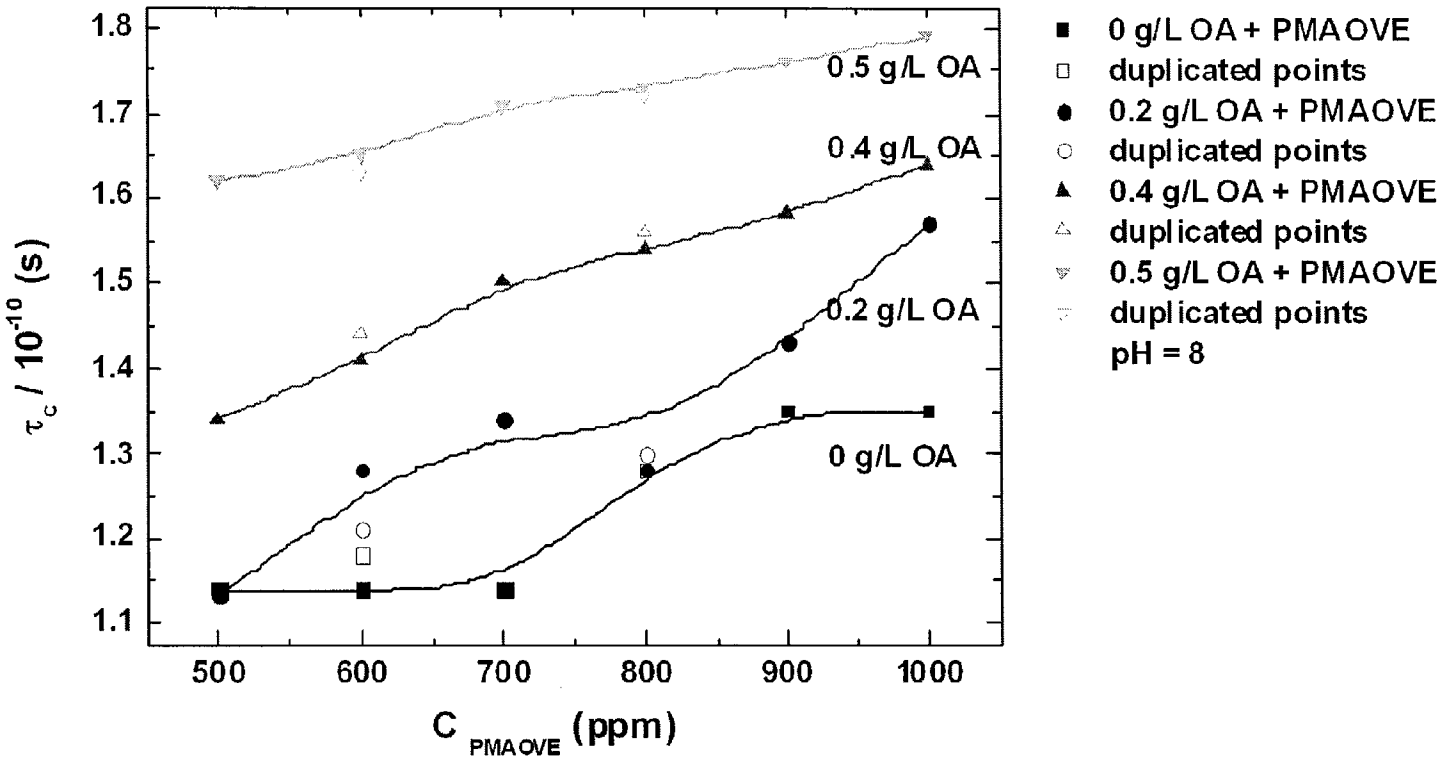
FIGS. 15A-B illustrate graphical views of variation of $\tau_c$ and $A_N$, according to some embodiments.
Figure 15B:
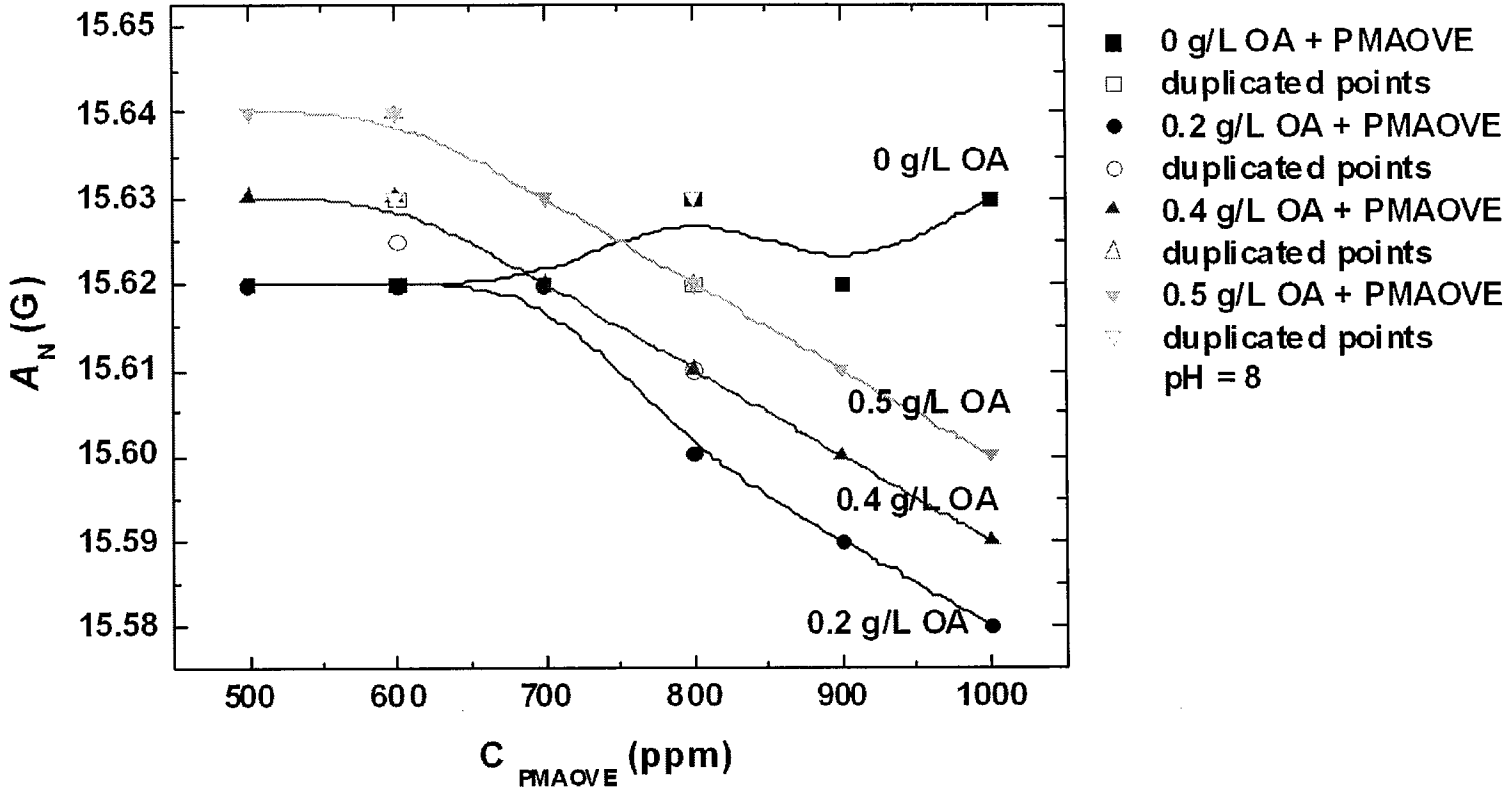

Variation of the rotational correlation time ($\tau_c$) (a) and hyperfine coupling constant ($A_N$) (b) of oleic acid/PMAOVE aggregates with PMAOVE concentration is shown in FIGS. 15A-B.

Figure 16A:
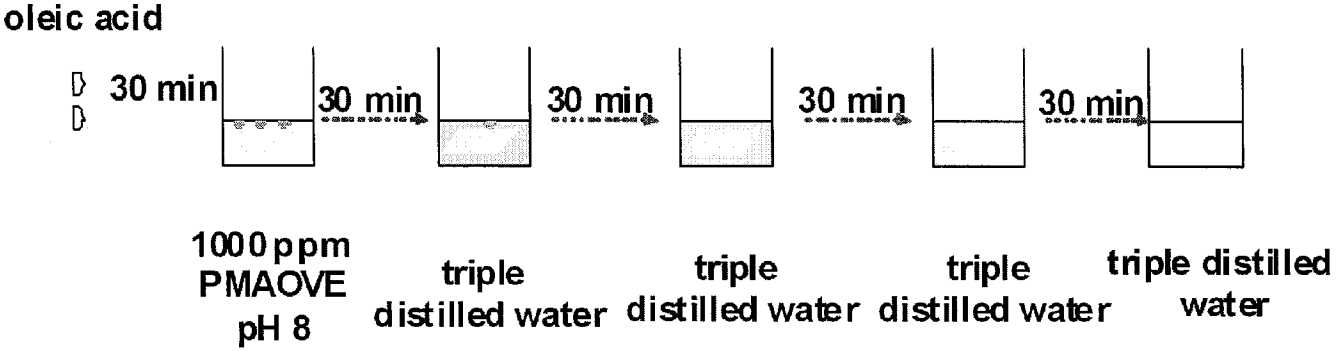
FIGS. 16A-B illustrate schematic views of a procedure for studying the interactions of oleic acid and PMAOVE on a substrate's surface, according to some embodiments.
Figure 16B:
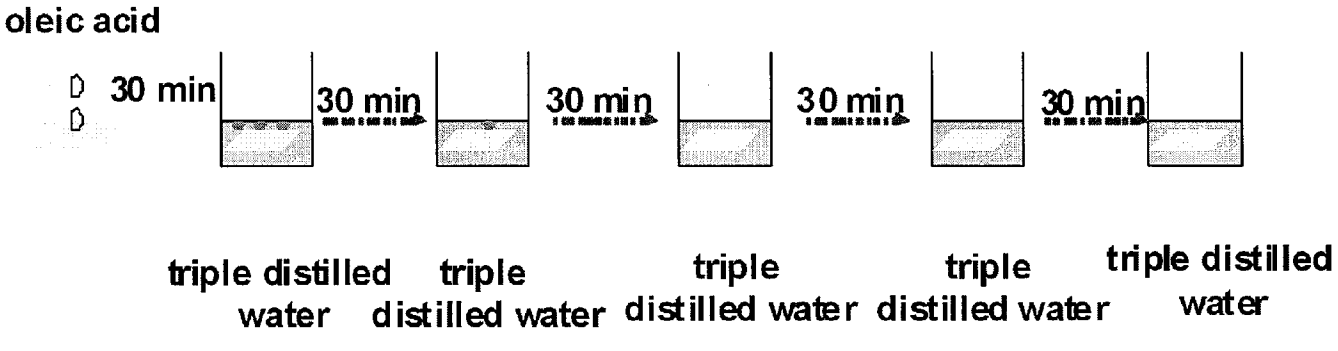

The Removal of Oleic Acid from Surface by PMAOVE; the Observation of Removal Oleic Acid from Fabric by PMAOVE:

FIGS. 16A-B illustrates the procedure used to study the interactions of oleic acid and PMAOVE on the fabric's surface. In the first experiment, washing of a stained fabric was simulated by stirring it in PMAOVE solution for 30 mins. As shown in the schematic diagram (see FIG. 16A), the PMAOVE solution remained clear, indicating that the oleic acid-polymer complex is water soluble. The fabric was then placed in water to simulate the rinsing cycles. Due to the absence of detergent (i.e., PMAOVE) and the water insolubility of oleic acid in these cycles, the solution turned turbid. These observations were tested by performing a blank experiment, where the stained fabric was washed with only water. It can be seen from FIG. 16B that all the solutions were turbid. This example clearly showed that polymer-stain complex is water soluble.

Figure 17:
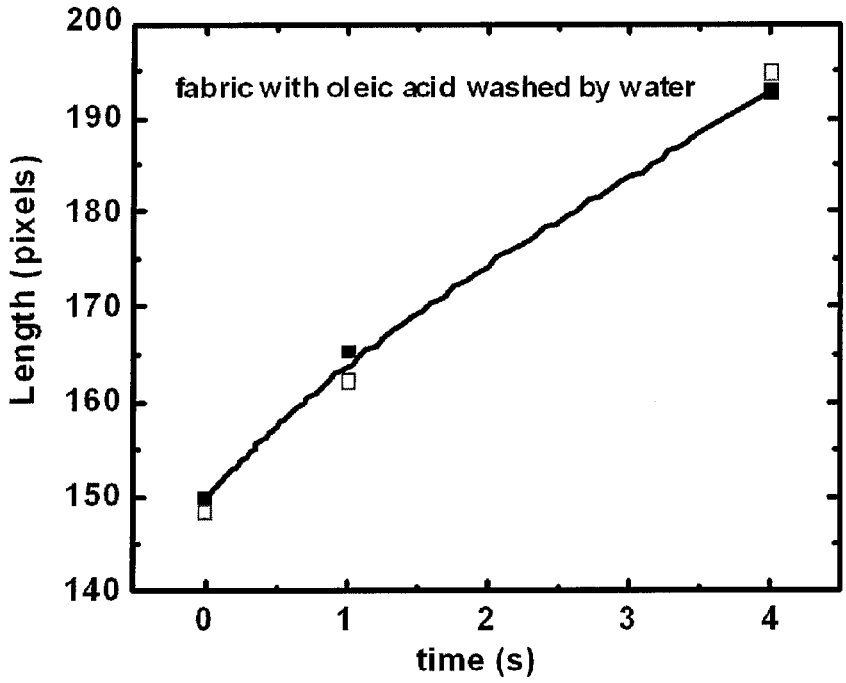
FIG. 17 illustrates a graphical view of the spreading of water in contact with a substrate as a function of time, according to some embodiments.

Properties of Stained Fabric Treated by Different Solutions; Fabric with Oleic Acid Washed by Water Only:

The water droplet penetrated into the fabric in 4 s. The spreading of water as a function of time is shown in FIG. 17. As can be seen in the graph, the diameter of the water droplet increases from 150 pixels to 190 pixels in 4 s, indicating that droplet can spread on the fabric surface. Thus, the interaction of water droplet with the fabric can be separated into penetration and spreading. Both spreading and penetration are important phenomena that decide the extent of interaction of stains with fabric surface. Study of these two parameters, therefore, is important.

Figure 18:
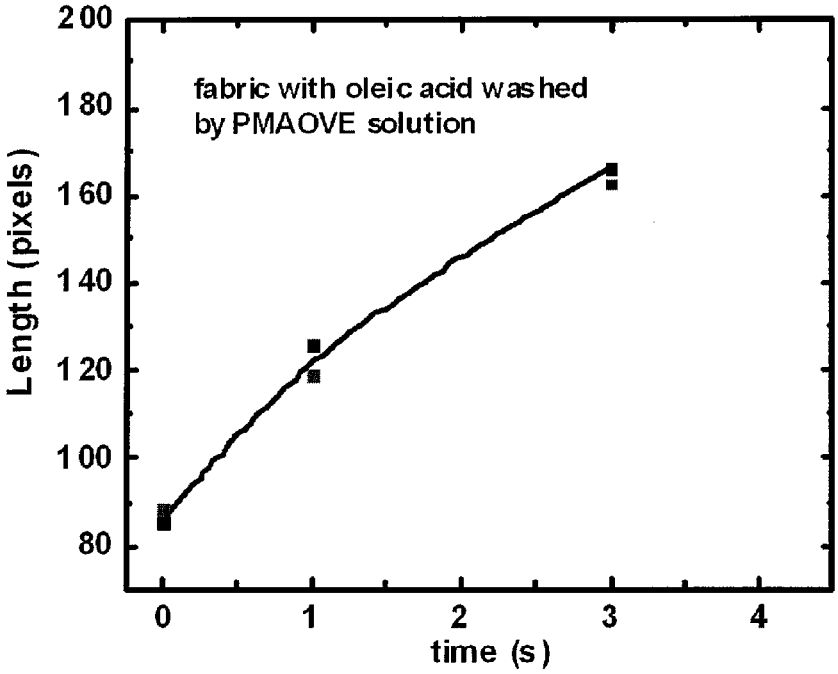
FIG. 18 illustrates a graphical view of a change in droplet diameter, according to some embodiments.

Fabric with Oleic Acid Washed by PMAOVE Solution (1000 ppm, pH 8):

Within 3 seconds, almost all of the water penetrated into the fabric. The change in the droplet diameter is shown in FIG. 18. In 3 s, the diameter increased from 85 pixels to 165 pixels. It can be seen that in this case the spreading and penetration are both faster, indicating that the PMAOVE solution is effective in removing oleic acid from the fabric surface. On the other hand, the contact angle of water droplet on the fabric with oleic acid treated by PMAOVE is larger than that of the fabric treated with water. This means that the hydrophobicity of stained fabric washed with PMAOVE solution is larger than that of the one washed with water due to the existence of PMAOVE on the fabric surface.

Figure 19:
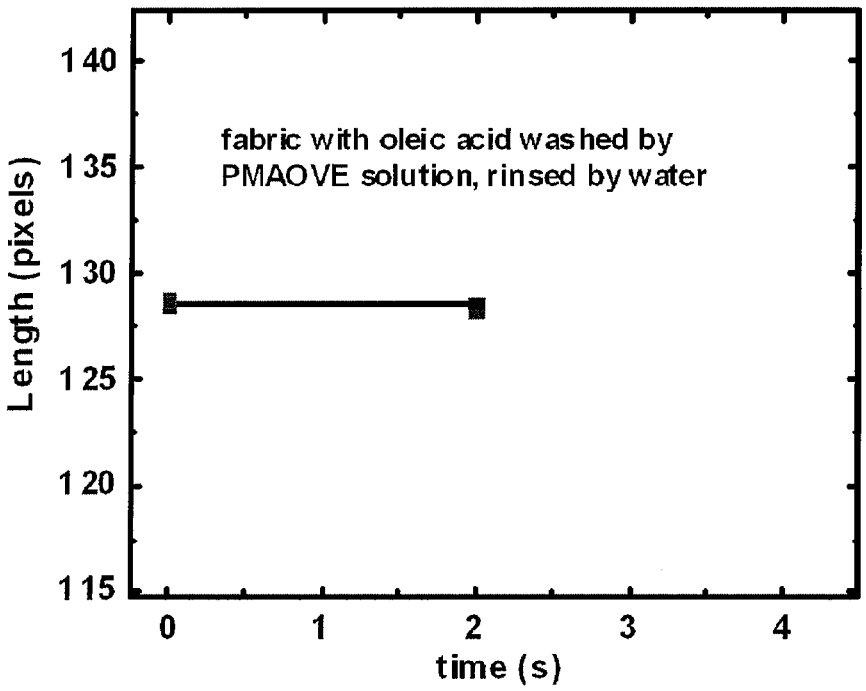
FIG. 19 illustrates a graphical view of a change in droplet diameter, according to some embodiments.

Fabric with Oleic Acid Washed with PMAOVE Solution (1000 ppm, pH 8), then Rinsed with Water:

In this case, after the detergent wash, the stained fabric was rinsed with water to simulate the final step of the washing cycle. The water droplet penetrated into the fabric immediately, and the diameter remained almost same (see FIG. 19). As stated earlier, oleic acid can interact with PMAOVE to form mixed complexes that are water-soluble. Therefore, during the water rinse cycle, the mixed complexes were evidently dissolved leaving the fabric surface very hydrophilic, allowing for the water to penetrate the surface very easily.

Figure 20A:
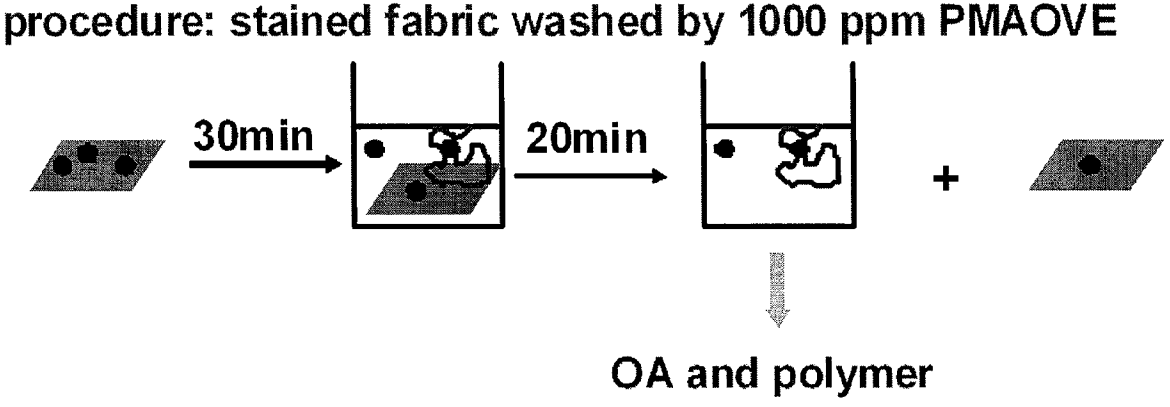
FIGS. 20A-B illustrate schematic views of a procedure to measure the amount of oleic acid removed from a substrate by PMAOVE, according to some embodiments.
Figure 20B:
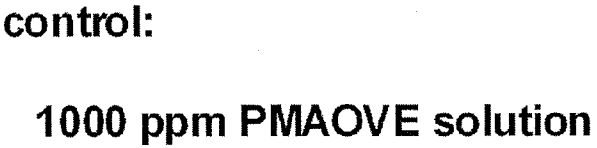

Removal of Oleic Acid from Fabric Surface by PMAOVE; TOC Results for the Amount of Oleic Acid Removed from the Fabrics by 1000 ppm PMAOVE at pH 8:

FIGS. 20A-B illustrate the procedure used to measure the amount of oleic acid removed from fabrics by 1000 ppm PMAOVE at pH 8. First, the stained fabrics were washed with 1000 ppm PMAOVE at pH 8 for 20 minutes and then the stained fabrics were taken out of the solution. TOC was used to measure the total carbon content of these solutions. The TOC value included the carbon content from PMAOVE and oleic acid. In the control experiment, the carbon content of 1000 ppm PMAOVE was measured by TOC. The carbon content of the oleic acid in the solution can be obtained by subtracting the carbon content from the control experiment. Here, we report the ratio of the amount of oleic acid removed from the fabrics by PMAOVE to the amount of the initial deposited oleic acid. The results are listed in Table 1. When the amount of initial deposited oleic acid on the fabric is 0.02 mL, the ratio at pH 8 is about 75%, while that for the repeat test, the ratio is 49%. This large difference might be because we assume that the entire polymer was left in the solution in the present procedure. Actually, there should be some polymer left on the fabric even though the polymer/oleic acid complexes are water soluble. The fact that some carbon may come out from the fabrics when they are washed in the polymer solution is another reason for the large difference. Therefore, the TOC test alone is not enough to monitor the amount of oleic acid removed from the fabrics. For this reason, we developed spectroscopic techniques to identify the oleic acid and polymer on the fabrics.

TABLE 2

The results of the amount of oleic acid removed from the fabrics by 1000 ppm PMAOVE at pH 8.

| Initial oleic acid | Total carbon content | Carbon content from PMAOVE | Carbon content from the fabrics | The amount of removed OA | The ratio of removed OA to initial added OA |
|---|---|---|---|---|---|
| 0.02 mL (0.0185 g) | 1108 ppm (25.5 mL) | 553.78 ppm | 10.47 ppm | .0139 g | 75% |
| 0.02 mL (0.0175 g) | 917.9 ppm (25 mL) | 564.86 ppm | 10.26 ppm | .00857 g | 49% |
| 0.05 mL (0.0430 g) | 1460.7 ppm (27 mL) | 523.01 ppm | 11.08 ppm | 0.0250 g | 58% |

Notes:
1. for 1000 ppm PMAOVE: TOC = 706.07 ppm
for untreated fabric washed by 20 mL water: TOC = 8.21 ppm TOC Measurements were Performed to Monitor the Carbon Content of Oleic Acid Solutions after Soaking the Fabrics for 30 Min:

For the above TOC results, we suggested that the carbon release from the fabrics may be responsible for the large difference observed (75% vs 49%). In the following experiments, TOC tests were conducted to measure the carbon content of a series of oleic acid solutions after soaking the fabrics for 30 min. The results are listed in Table 2. As shown in Table 2, at lower oleic acid concentrations (<0.1 g/L), the TOC values after soaking the fabrics are less than the TOC values before soaking the fabrics, which may be due to some oleic acid being adsorbed on the fabrics. However, after soaking the fabrics at the higher oleic acid concentrations (0.2~2 g/L), the TOC values are higher than the TOC values before soaking the fabrics, which suggests that organic carbon is released by the fabrics upon soaking.

TABLE 3

The TOC values of oleic acid before and after soaking the fabrics.

| Sample | TOC (ppm) before soaking fabric | TOC (ppm) after soaking fabric |
|---|---|---|
| 0 g/L (0 ppm) OA | 7.495 pH 11 water (was subtract in the following results) | 7.147 (was subtract in the following results) |
| 0.01 g/L (0 ppm) OA | 3.325 | 0.808 |
| 0.02 g/L (20 ppm) OA | 9.485 | 6.888 |
| 0.05 g/L (50 ppm) OA | 28.615 | 27.398 |
| 0.1 g/L (100 ppm) OA | 62.025 | 64.008 |
| 0.2 g/L (200 ppm) OA | 125.805 | 139.038 |
| 0.5 g/L (500 ppm) OA | 332.82 | 254.608 |
| 0.8 g/L (800 ppm) OA | 533.98 | 566.828 |
| 1 g/L (1000 ppm) OA | 671.53 | 747.028 |
| 1.5 g/L (1500 ppm) OA | 1002.88 | 1118.608 |
| 2 g/L (2000 ppm) OA | 1338.22 | 1443.158 |

Figure 21:
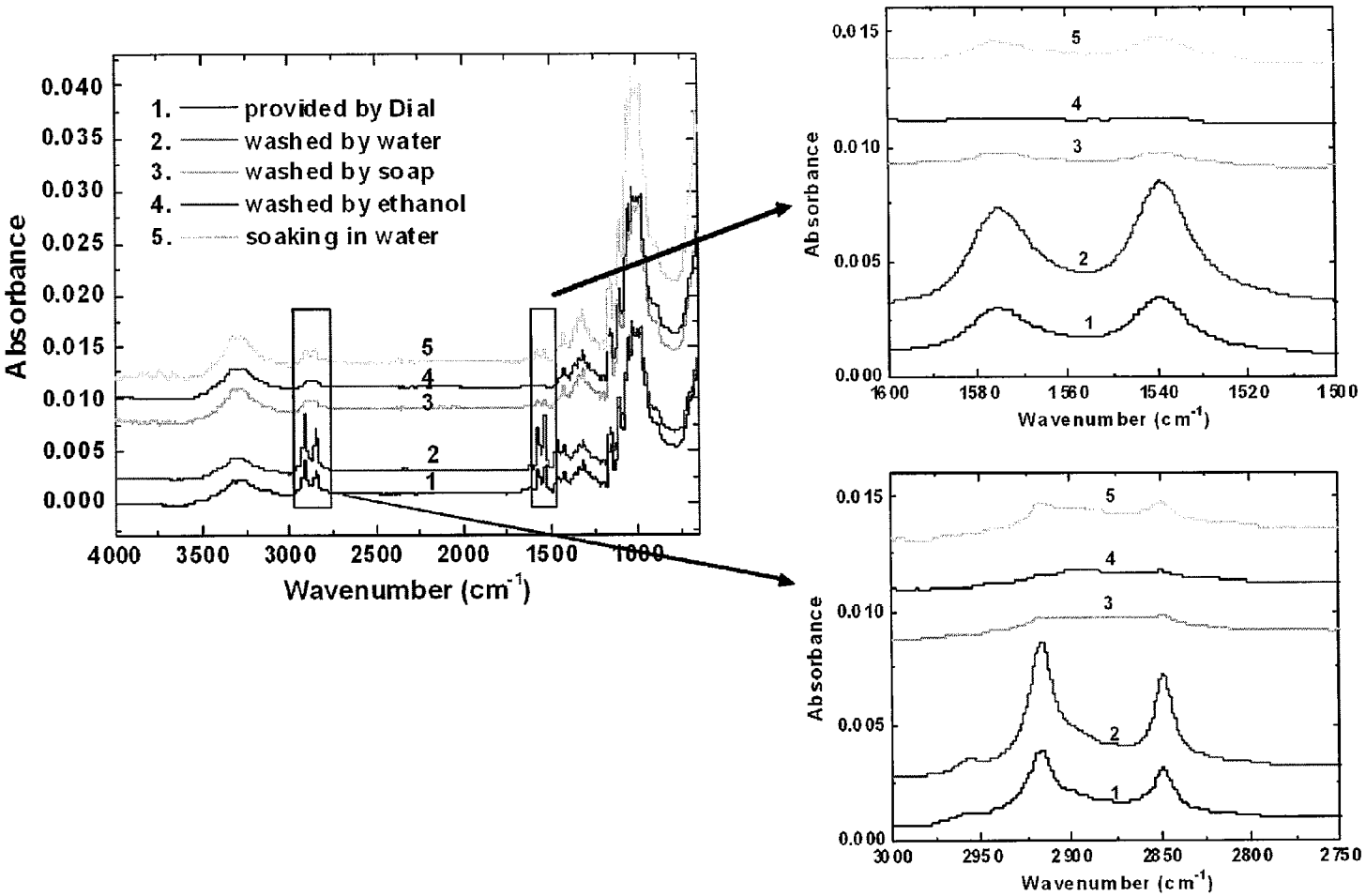
FIG. 21 illustrates a graphical view of infrared spectra for substrates contacted with various reagents, according to some embodiments.

Fabric Treatment to Remove the Organic Contamination:

In order to remove the organic contamination, the fabrics were washed with several types of solvents. After treatment, FTIR tests were performed to monitor the properties of the fabric surface. As shown in FIG. 21, for the untreated fabric the absorbance between 3000-2750 $cm^{-1}$ and 1600-1500 $cm^{-1}$ was assigned to the stretching vibration of C—H and the asymmetric stretching vibration of the $CO_2^-$ moiety, respectively. This contamination could be due to the procedure of producing fabrics and could disturb the identification of oleic acid by spectroscopic tools. After washing the fabrics with water, the absorbance in these two regions appeared to be increasing when compared with the spectrum of untreated fabric. This was possibly due to the contamination inside the pores that was coming out to the surface. However, after washing the fabrics with soap or ethanol, or soaking them in water for overnight, the absorbance in these two regions decreased significantly, suggesting that the contamination could be removed by washing with soap or ethanol. Relatively speaking, ethanol is the most effective solvent to remove the contamination among the tested solvents. Therefore, in the following experiments, all of the fabrics were washed in ethanol before the further treatment. FT-IR spectra of (1) untreated fabric; (2) fabric washed by water; (3) fabric washed by soap; (4) fabric washed by ethanol; (5) fabric soaked in water overnight (see FIG. 21).

Figure 22:
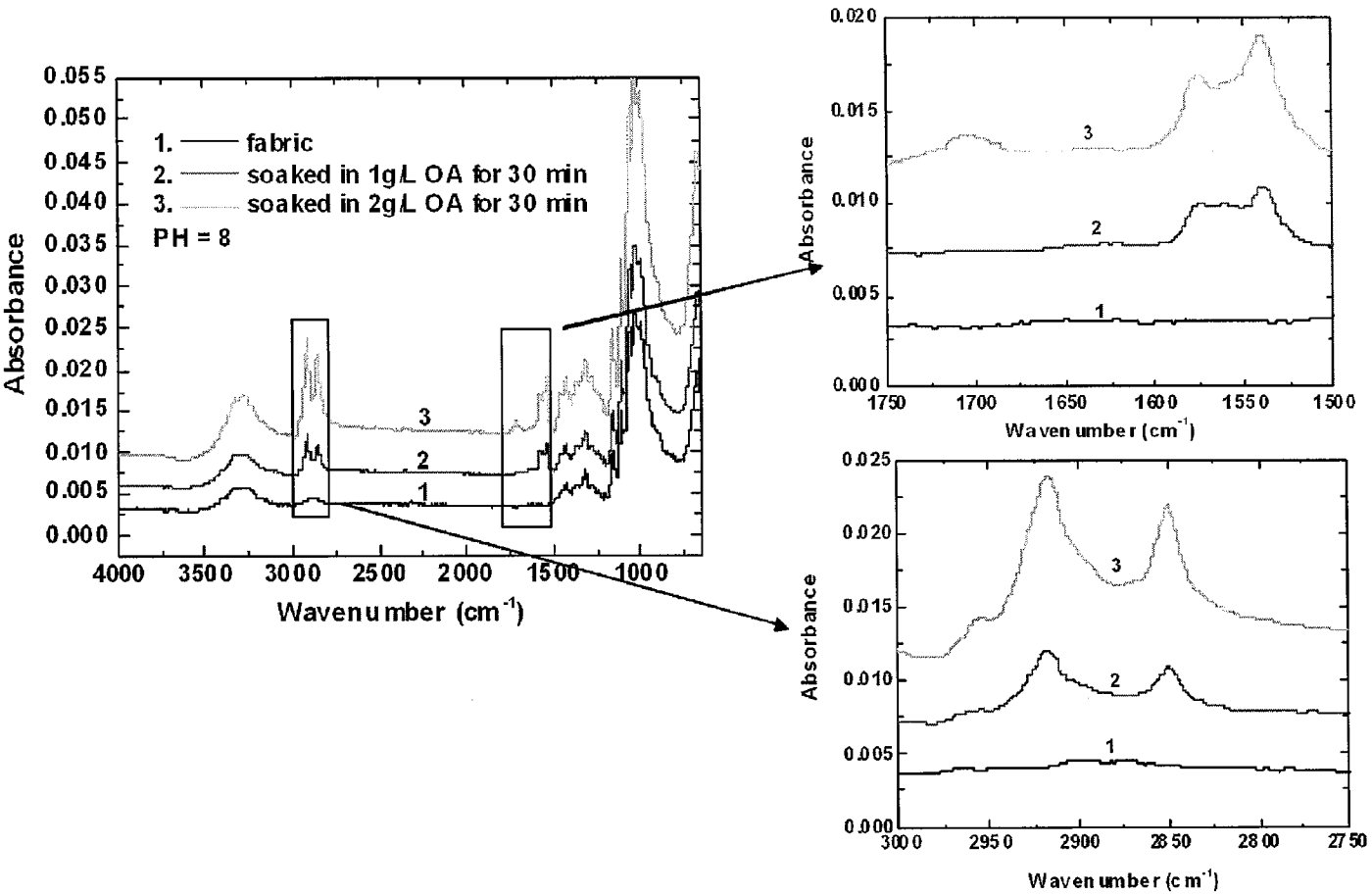
FIG. 22 illustrates a graphical view of infrared spectra of substrates contacted with oleic acid, according to some embodiments.
Figure 23:
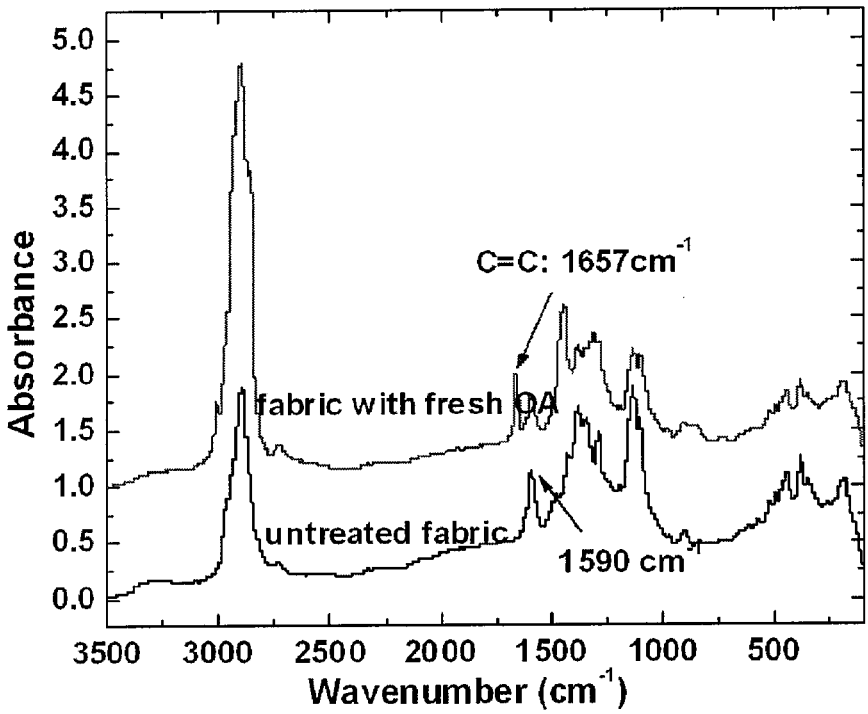
FIG. 23 illustrates a graphical view of infrared spectra of treated and untreated substrate, according to some embodiments.

Testing of the Potential of Using FTIR and Raman Spectra to Identify the Oleic Acid Adsorbed on the Fabrics:

In the above work, only TOC was used to measure the amount of oleic acid removed from the fabrics by PMAOVE solution. It was found that a large variation for the repeat experiments, which implied that TOC alone can not be used to monitor the amount of oleic acid. Therefore, spectroscopic techniques—FTIR and Raman were conducted for identifying the oleic acid on the fabrics. FIG. 22 shows the spectra of fabrics that were soaked in 1 g/L and 2 g/L oleic acid solutions. The absorbance between 1600-1500 $cm^{-1}$ and 3000-2750 $cm^{-1}$ increased with an increase in the oleic acid concentration, suggesting that the amount of oleic acid adsorbed on the fabrics also increased with increase in the concentration of oleic acid solutions. The absorbance between 1600-1500 $cm^{-1}$ was assigned to the asymmetric stretching vibration of the carbonyl of oleic acid, while the absorbance between 3000-2750 $cm^{-1}$ was attributed to the stretching vibration of $CH_2$ group. Furthermore, it should be noted that there was an extra peak at about 1700 $cm^{-1}$ for the fabric soaked in 2 g/L oleic acid due to the adsorption of oleic acid monomer on the fabric surface. Raman experiments on the fabrics treated with oleic acid were also performed. As shown in FIG. 23, compared with the spectrum of the untreated fabric, for the stained fabric, there was an extra peak at abound 1657 $cm^{-1}$ which was the C═C stretching vibration of the oleic acid. The spectrum results indicated that FTIR and Raman spectrum techniques are effective tools for characterizing the untreated and stained fabrics. FT-IR spectra of (1) fabric washed by ethanol is shown; (2) fabric soaked in 1 g/L OA for 30 min; (3) fabric soaked in 2 g/L OA for 30 min (see FIG. 22).

Figure 24A:
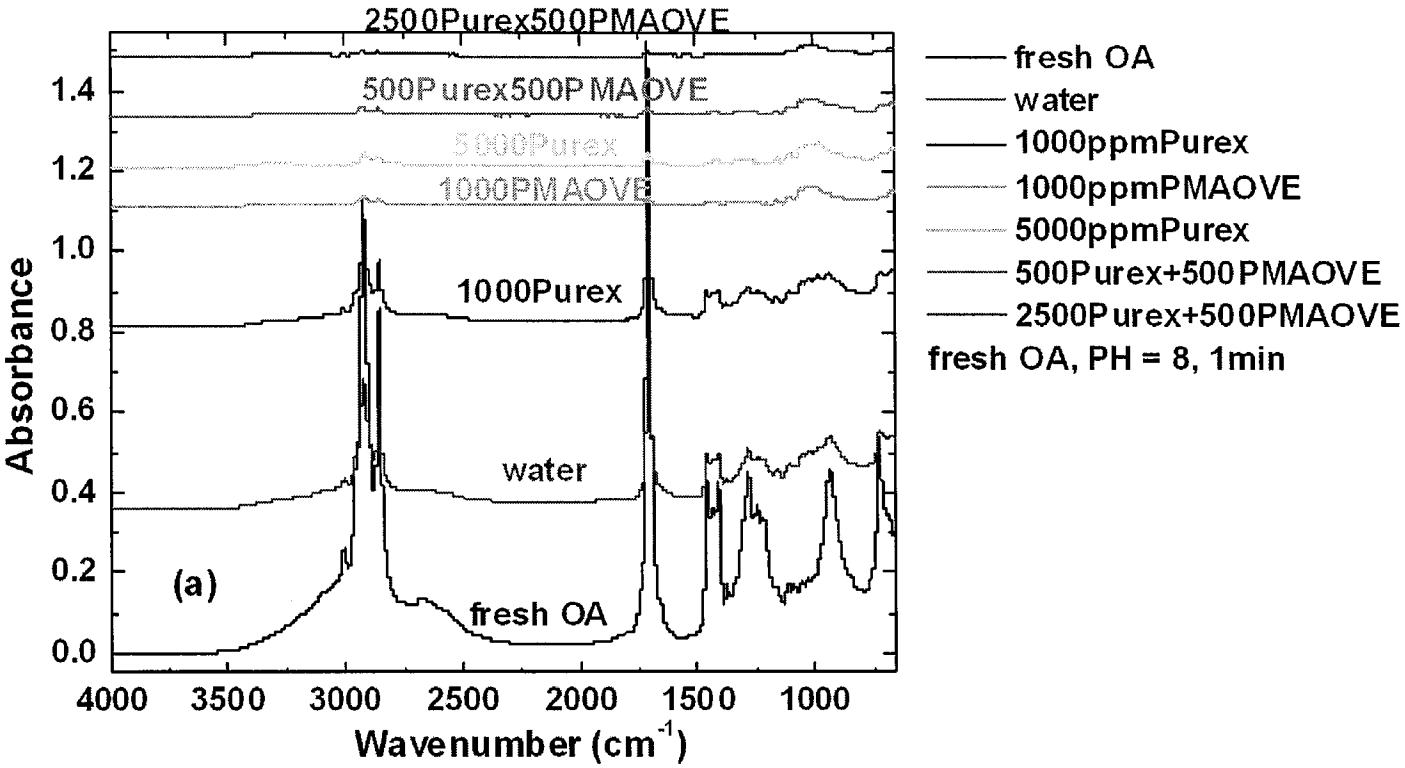
FIGS. 24A-B illustrate graphical views of infrared spectra of fresh oleic acid on substrate surfaces after washing, according to some embodiments.
Figure 24B:
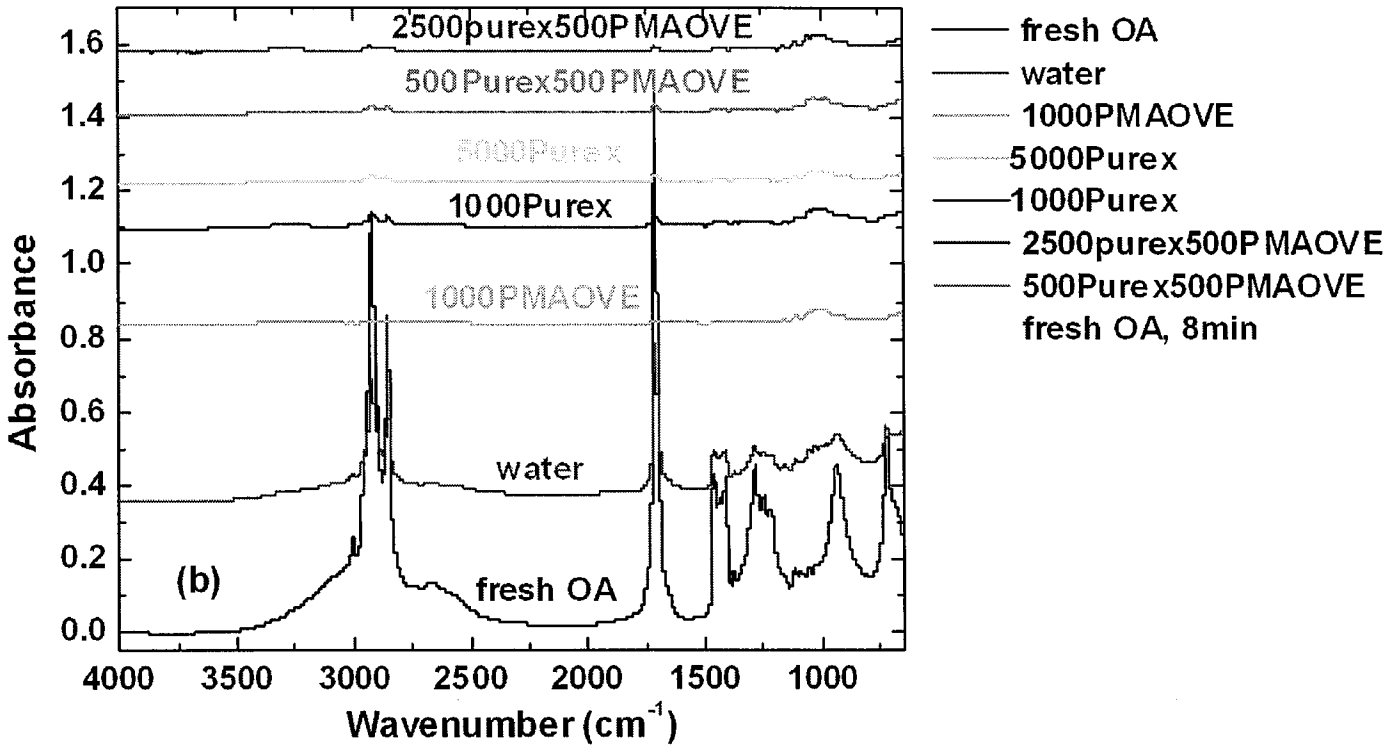
Figure 25A:
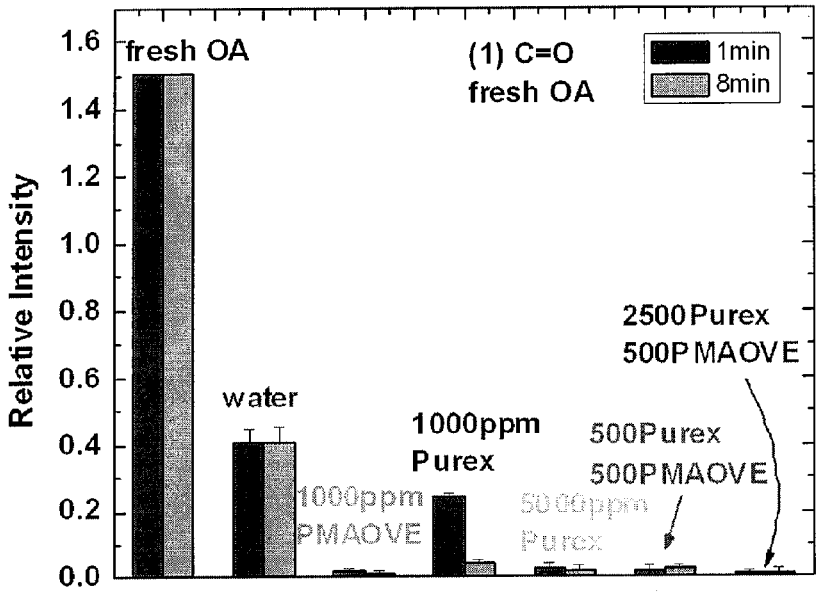
FIGS. 25A-C illustrate graphical views of the relative intensity of absorbance regions from FIG. 5, according to some embodiments.
Figure 25B:
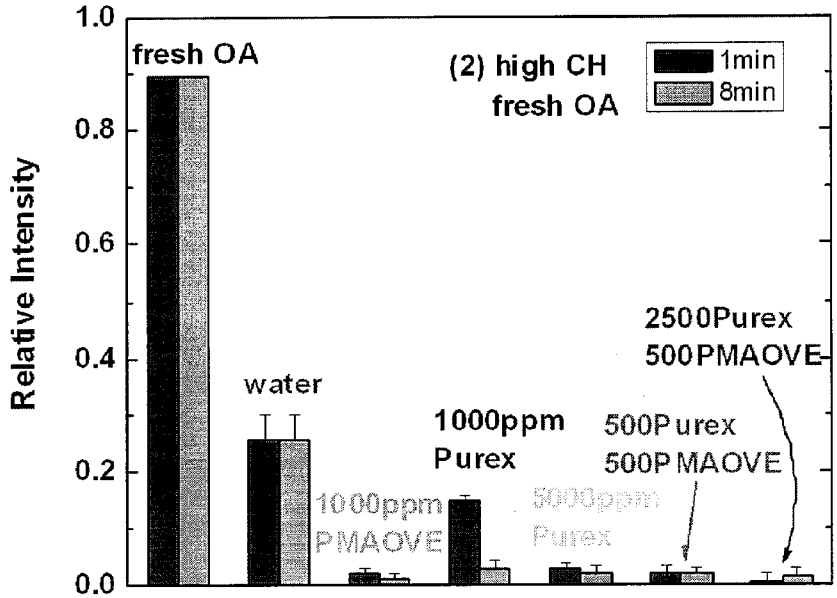
Figure 25C:
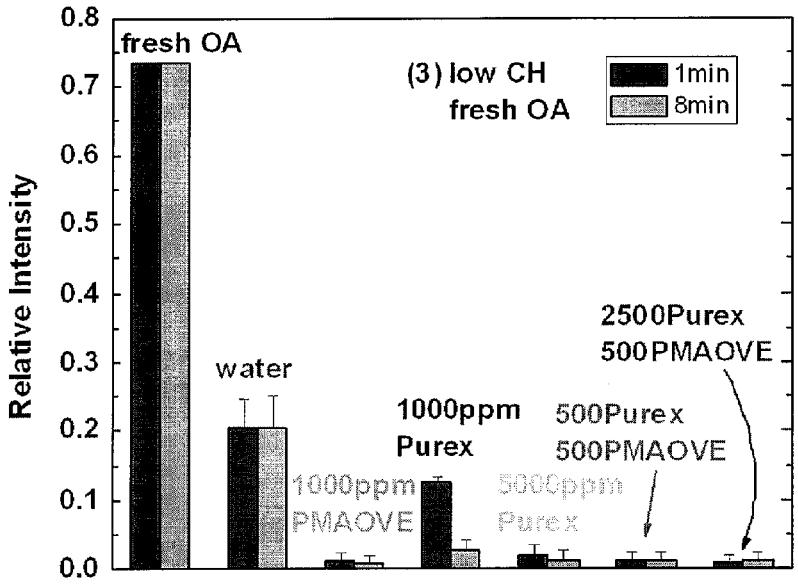
Figure 26A:
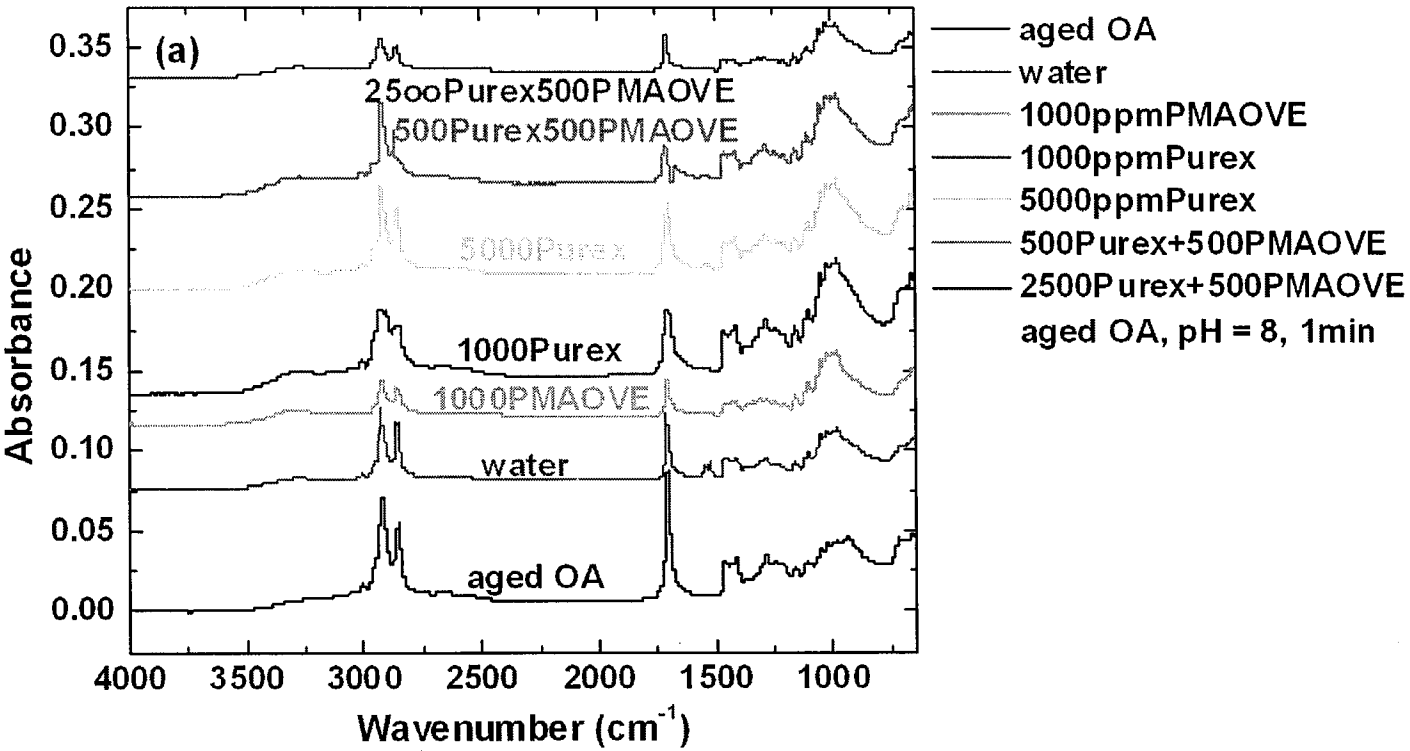
FIGS. 26A-B illustrate graphical views of infrared spectra of stained substrates after washing, according to some embodiments.
Figure 26B:
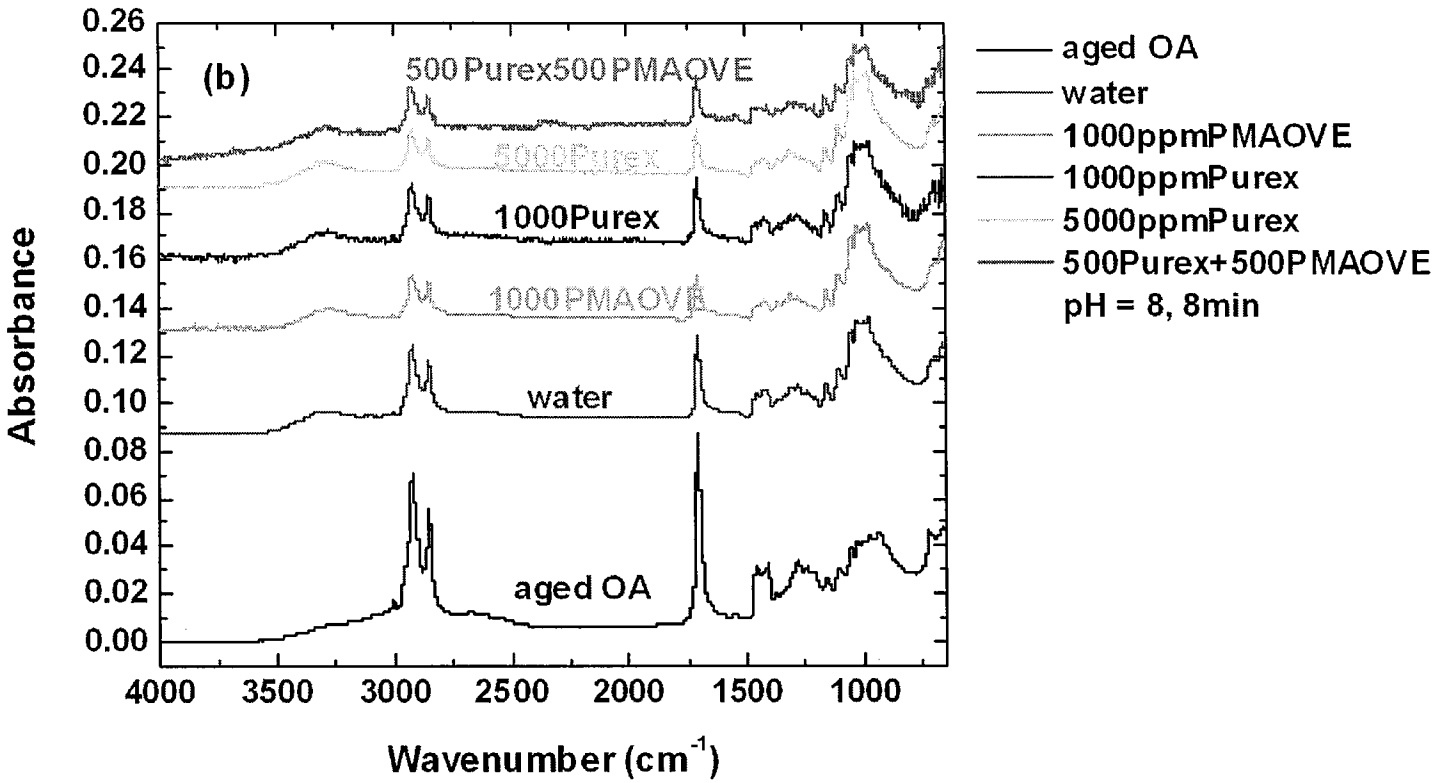
Figure 27A:
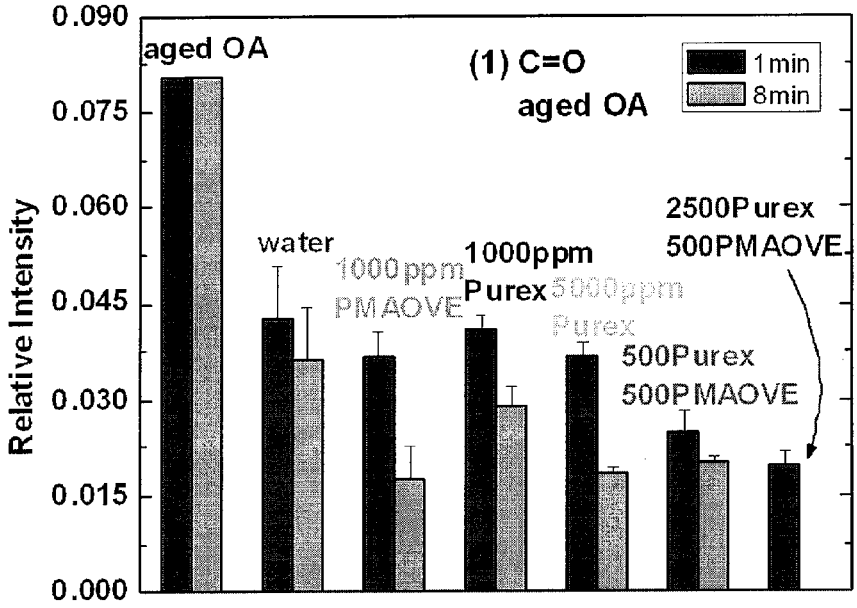
FIGS. 27A-C illustrate graphical views of relative intensity of absorbance in regions from FIG. 7, according to some embodiments.
Figure 27B:
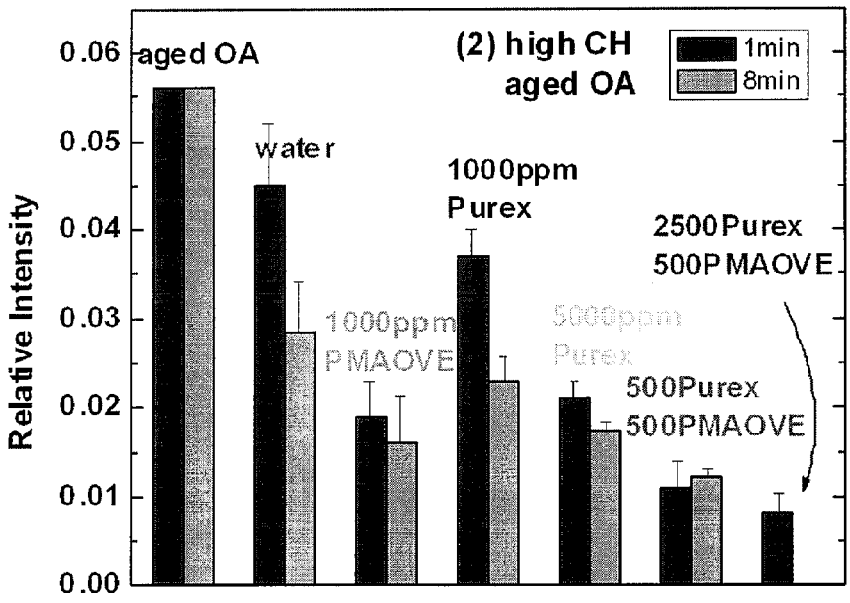
Figure 27C:
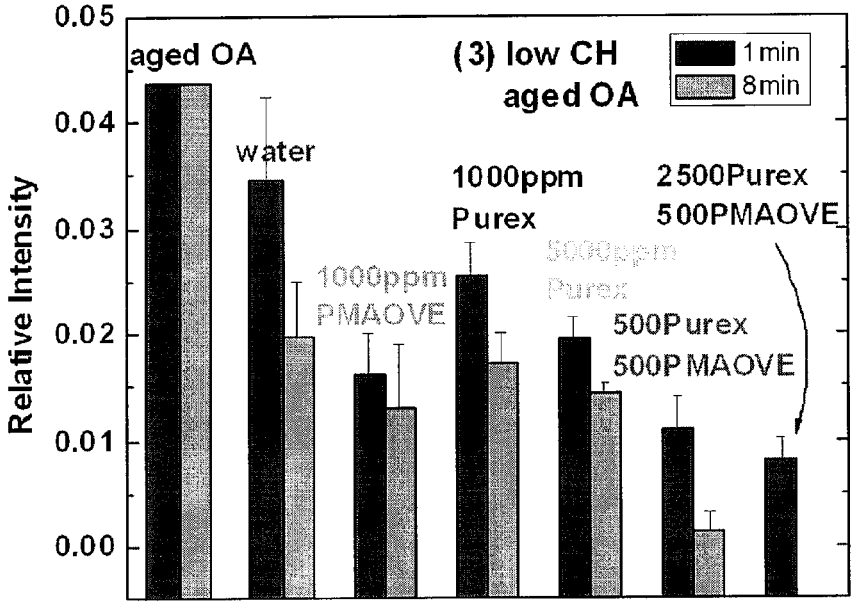
Figure 29:
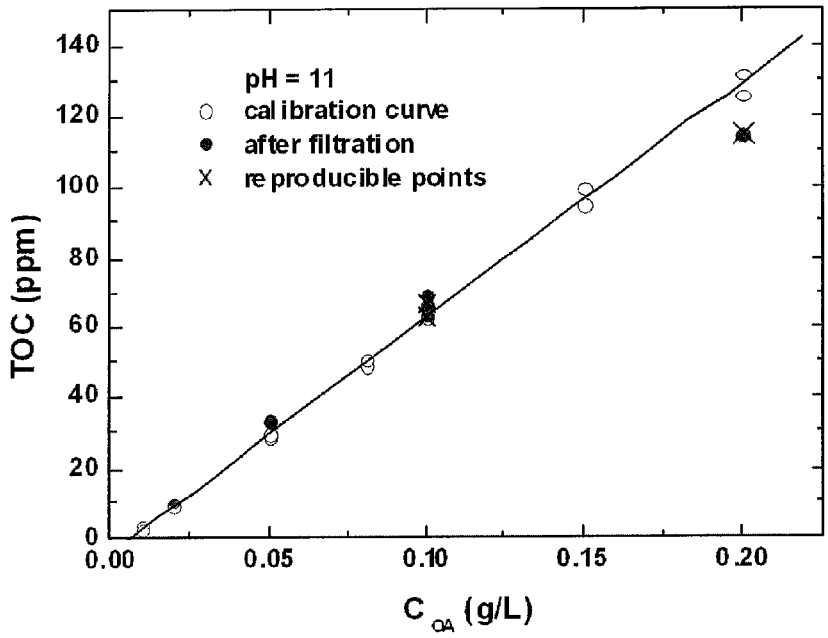
FIG. 29 illustrates a graphical view of the dependence of TOC for oleic acid after filtration on the oleic acid concentration, according to some embodiments.

FTIR was Used to Identify the Oleic Acid Adsorbed on the Fabric after the Stained Fabric was Washed with PMAOVE, HDL, and PMAOVE/HDL Mixed Solution:

As discussed above, PMAOVE was used to remove oily stain (fresh and aged oleic acid) from the fabric surfaces. Commercial HDL detergent and the HDL/PMAOVE mixture were used for comparison. In the example, the amounts of residual oily stain (fresh and aged) on the fabric washed by HDL, PMAOVE, and HDL/PMAOVE mixture were monitored by FTIR. FIGS. 24A-B show the FTIR spectra of fresh oleic acid on fabric surfaces after washing. The absorbance between 1600-1500 $cm^{-1}$ was assigned to the asymmetric stretching vibration of the carbonyl of oleic acid, while the absorbance between 3000-2750 $cm^{-1}$ was attributed to the stretching vibration of $CH_2$ group. The changes of the relative intensity in these two regions are shown in FIG. 29. After the stained fabrics were washed by HDL, PMAOVE, and HDL/PMAOVE, the absorbance in these regions decreased markedly, following the sequence: water>1000 ppm HDL>5000 ppm HDL≈1000 ppm PMAOVE≈500 ppmHDL/500 ppmPMAOVE>2500 ppmHDL/500 ppmPMAOVE. These results indicated that PMAOVE is more effective for removing the oily stain from the fabric surfaces than HDL detergent. Moreover, the HDL/PMAOVE mixture was the most effective than any individual polymer possibly due to the synergistic effect. The washing time affected the removal ratio of fresh oleic acid from the fabric surfaces by HDL detergent and HDL detergent/PMAOVE mixture, as the absorbance of residual oily stain on fabric for 8 min (washing time) was smaller than that of 1 min, suggesting the longer the washing time, the higher is the removal ratio of stain. The effectiveness of removal of aged oleic acid from the fabric surface was also studied. It was observed that it is more difficult to remove the aged oleic acid than the fresh oleic acid owing to the oxidation of C═C bond, which affects the binding interaction between the polymers and stain components. FTIR spectra of stained (fresh oleic acid) fabrics washed by HDL, PMAOVE, and the HDL/PMAOVE mixture is shown at pH 8 for 1 min (a) and 8 min (b) (see FIGS. 24 A-B). FIGS. 25 A-C show the relative intensity of the absorbance in regions 1600-1500 $cm^{-1}$ and 3000-2750 $cm^{-1}$ from FIG. 3. FIGS. 26A-B show FTIR spectra of stained (aged oleic acid) fabrics after washed by HDL, PMAOVE, and the HDL/PMAOVE mixture at pH 8 for 1 min (a) and 8 min (b). FIGS. 27 A-C show the relative intensity of the absorbance in regions 1600-1500 $cm^{-1}$ and 3000-2750 $cm^{-1}$ from FIG. 7.

Quantification of Oleic Acid:

Through the examples, it has been shown that oleic acid ages with time. Oleic acid solution may be kept under nitrogen or freshly prepared for any experiment. Total Organic Carbon (TOC) technique was found to be a useful tool for quantifying the stain concentration with a resolution up to ppm level while acid value analysis could be used if the stain concentration is more than 1 g/L.

Effective Removal of Stain Using Hydrophobically Modified Polymers:

The turbidity results showed that polymers can be used to enhance the solubilization of oleic acid in aqueous solution. Among the studied polymers (PMAOVE, Acusol polymers and HDL), hydrophobically modified PMAOVE polymer was found to be more effective than Acusol polymers or pure HDL. However, the HDL/PMAOVE mixture was the most effective for removing the oleic acid.

Mechanisms of Removal Enhancement of Hydrophobically Modified Polymers:

ESR and fluorescence results indicated that oleic acid has strong interactions with PMAOVE to form oleic acid/polymer aggregates. With increasing oleic acid concentration, the micropolarity of the aggregates decreased, while the microviscosity increased. However, with an increasing in PMAOVE concentration, the ESR results showed that the rotational correlation time ($\tau_c$) increased, while hyperfine coupling constant ($A_N$) decreased, suggesting that there was an increase in microviscosity and a decrease in micropolarity of the oleic acid/PMAOVE aggregates. From the fluorescence results it was apparent that $I_3/I_1$ values decreased with increasing PMAOVE concentration, indicating in an increased micropolarity of oleic acid/PMAOVE aggregates. The above opposite fluorescence and ESR results may be due to the different location of the probe. In general, this can be summarized as—with higher incorporation of reagent molecules in polymer domains, the domain viscosity and hydrophobicity increases.

Figure 28:
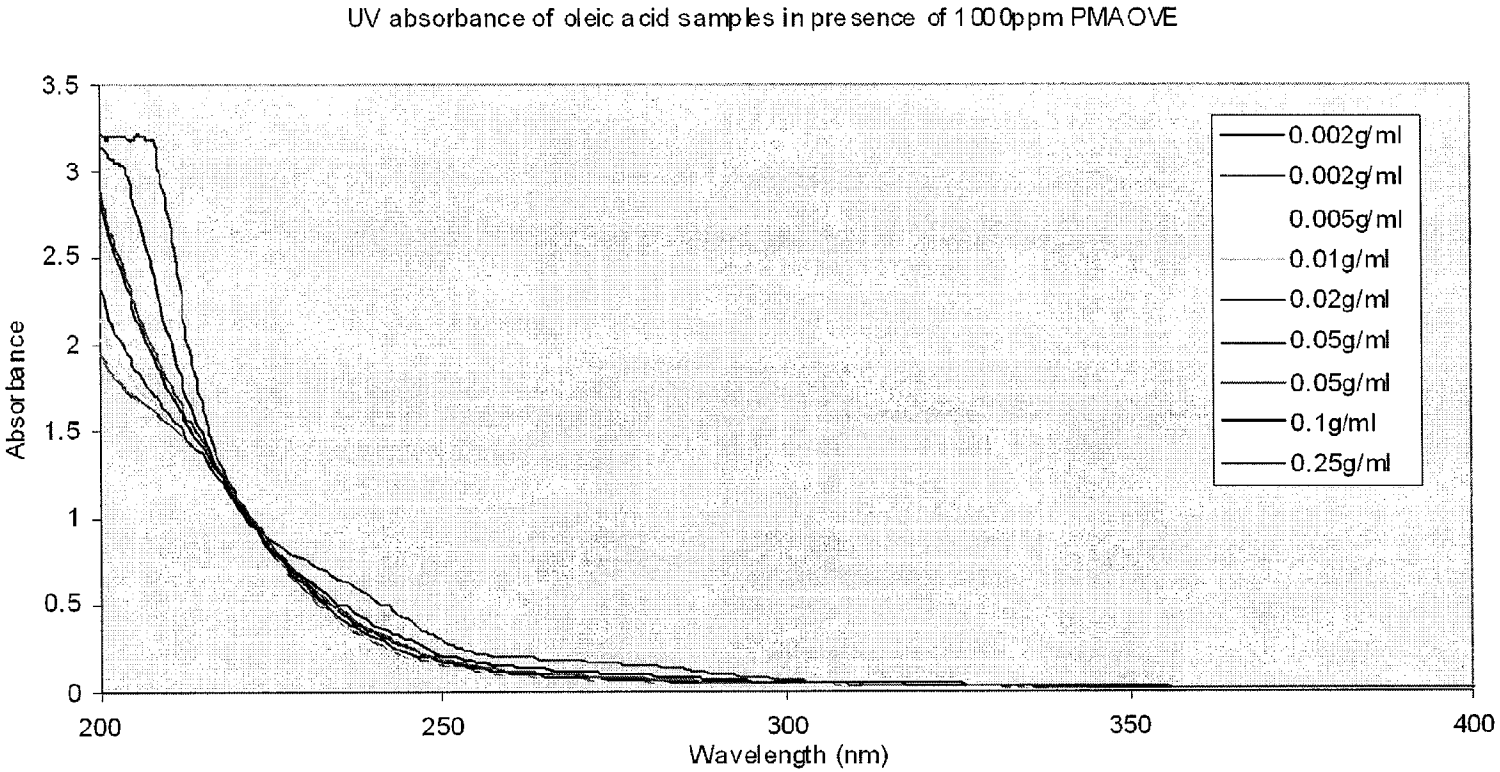
FIG. 28 illustrates a graphical view of the UV absorbance of a series of oleic acid concentrations in the presence of PMAOVE, according to some embodiments.

Removal Oleic Acid from Fabric Surface:

FTIR results have also indicated that the PMAOVE/HDL mixture was more effective than either PMAOVE or HDL in removing oleic acid from the fabric surface. It was also observed that it was more difficult to remove the aged oleic acid UV Response of Oleic Acid in the Presence of PMAOVE:

FIG. 28 shows the UV absorbance of a series of oleic acid concentrations in the presence of 1000 ppm PMAOVE. It is observed that the absorbance peak from the polymer completely masked the UV absorbance of the oleic acid, except for 0.1 g/L and 0.25 g/L oleic acid concentrations where a small shoulder could be seen at 240 nm.

Optimization of the Filtration Process:

Organics were found on the filter membrane, which affected the TOC results. To remove this contamination, the filter membrane was soaked overnight. The oleic acid concentrations were measured by TOC before and after filtration by using the treated filter membrane were similar to each other (see FIG. 29), indicating that the filtration process can be optimized to remove the organics from filter completely. FIG. 29 shows dependence of TOC for oleic acid after filtration on the oleic acid concentration.

Figure 30A:
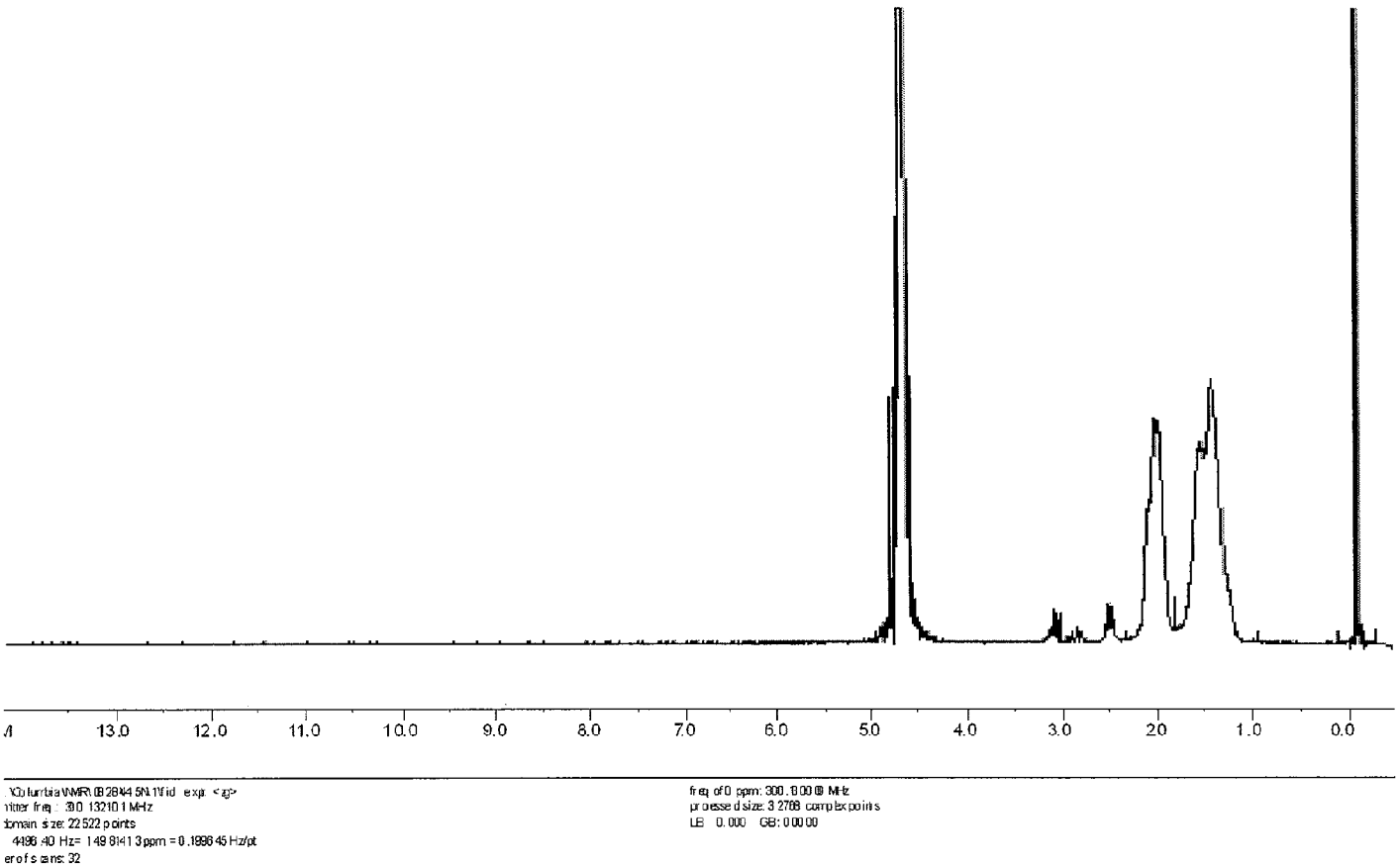
FIGS. 30A-C illustrate graphical views of the H-NMR results for Acusol and PMAOVE, according to some embodiments.
Figure 30B:
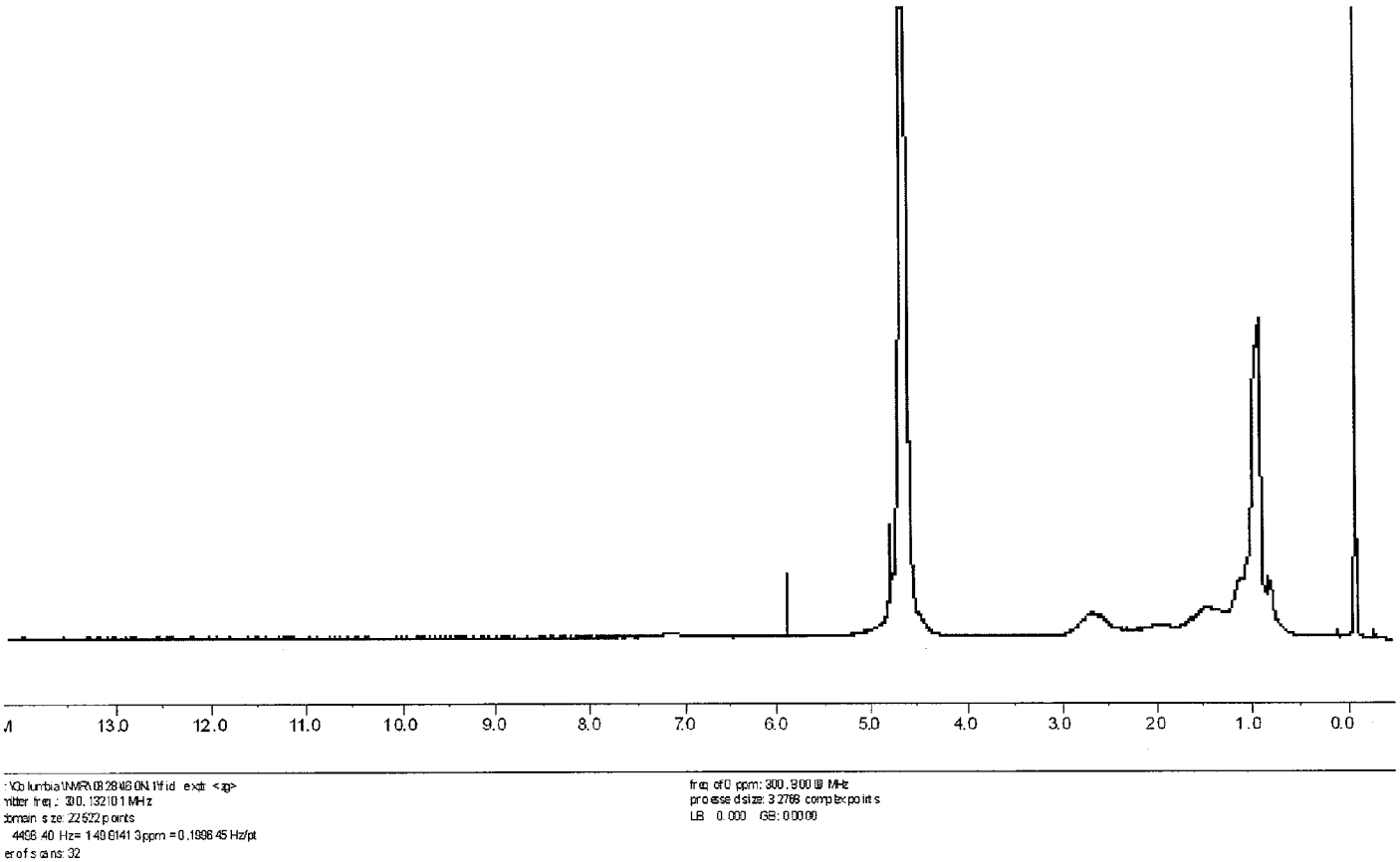
Figure 30C:
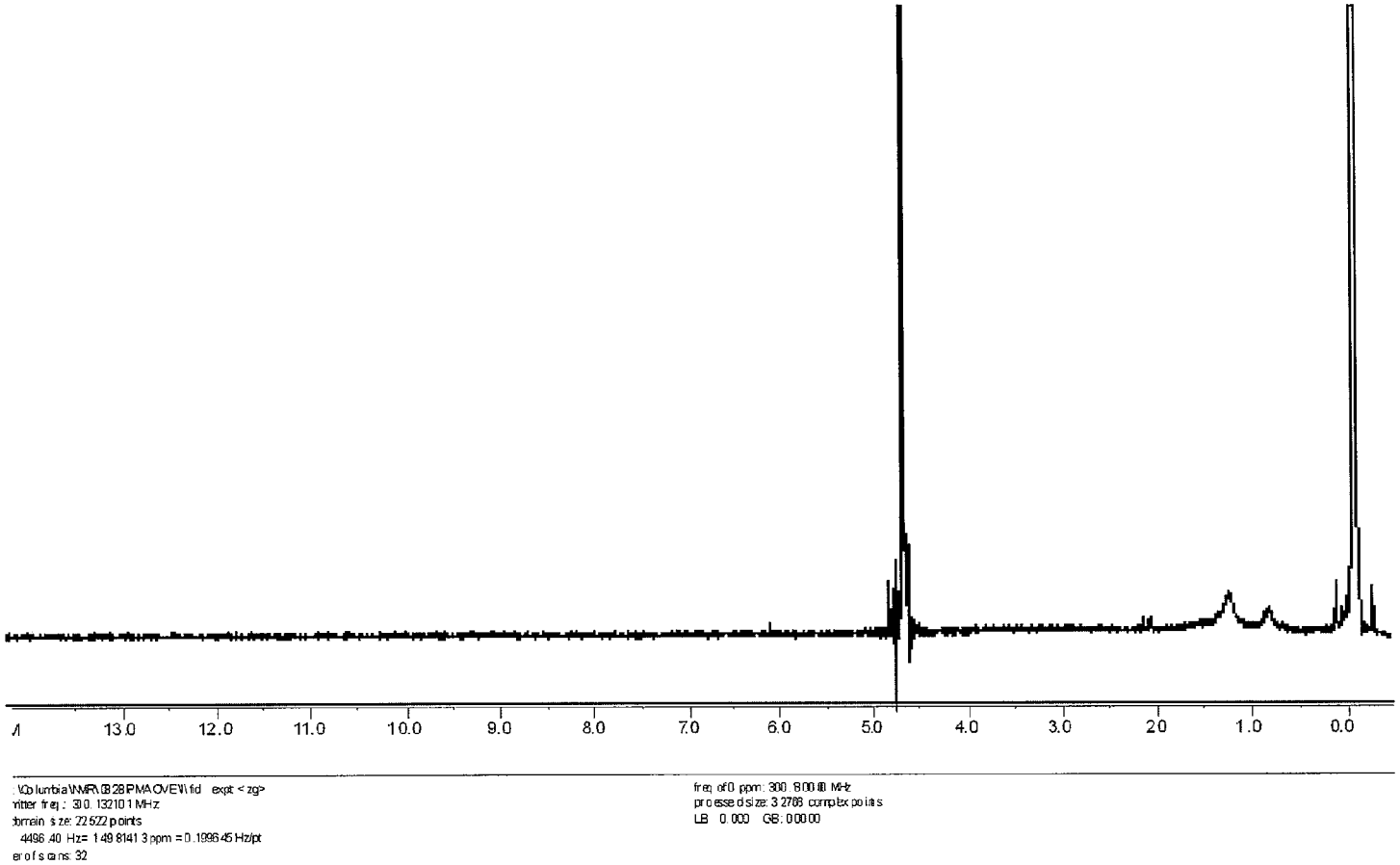
Figure 31:
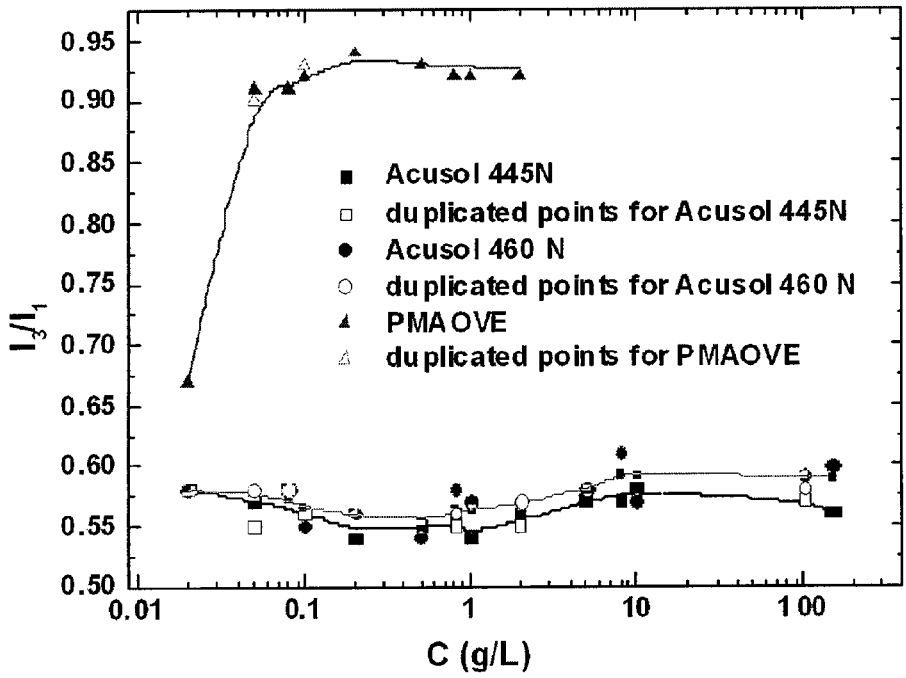
FIG. 31 illustrates a graphical view of variations in the binding isotherm for PMAOVE and Acusol polymers, according to some embodiments.

NMR Spectra of Acusol Polymers:

To get the information on commercially available compounds similar to PMAOVE, NMR analysis of Acusol polymers were performed. Since Acusol 445N (MW 4500) is a homopolymer of poly(acrylic acid), a NMR spectrum of pure PAA (MW 5000) was measured for comparison. NMR spectrum of PMAOVE was also measured. All the NMR spectra were measured in $D_2O$. The spectra were measured using TMS (Tetramethyl silane) as a reference (0 ppm). Acusol polymers were received as aqueous solutions, and hence the samples had a strong water peak at about 4.6 ppm in H-NMR. The H-NMR of Acusol 445N was similar to that of PAA, which confirmed that the structure of Acusol 445N is similar to that of PAA. FIGS. 30A-C show the spectra of (A) Acusol 445N, (B) Acusol 460 N and (C) PMAOVE:

The Properties of Acusol Polymers:

Fluorescence measurements were performed to get information on commercially available compounds Acusol 445N and Acusol 460N. FIG. 31 shows the variation of the pyrene polarity ratio $I_3/I_1$ for PMAOVE and Acusol polymers from steady-state fluorescence measurement. The $I_3/I_1$ curves for Acusol polymers are distinctly different from that for PMAOVE. In the investigated polymer concentration range, $I_3/I_1$ for PMAOVE increases as its concentration increases, revealing the formation of aggregates by the alkyl chains in PMAOVE solutions. When the PMAOVE molecules are dissolved in aqueous solution, the polymer alkyl chains tend to associate with each other forming micelle-like hydrophobic aggregates to minimize their exposure to water. However, for Acusol polymers, I3/I1 remains nearly constant at a low value, equivalent to that for water. This indicates that Acusol polymers may not be forming hydrophobic aggregates. In other words, Acusol polymers might not be able to interact with stains with hydrophobic interactions and may not dissolve organic stain molecules.

The detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The detailed description is, therefore, not to be taken in a limiting sense, and the scope of the present invention is defined by the appended claims and their equivalents.

In this document, the terms "a" or "an" are used to include one or more than one and the term "or" is used to refer to a nonexclusive "or" unless otherwise indicated. In addition, it is to be understood that the phraseology or terminology employed herein, and not otherwise defined, is for the purpose of description only and not of limitation. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

What is claimed is:

1. A detergent composition, comprising:

a poly(maleic acid/vinyl octyl ether) (PMAOVE) hydrophobically modified polymer; and a heavy duty liquid detergent;

wherein the detergent composition is such that an aqueous solution comprising 1 g/L of substantially unaged oleic acid and having a detergent composition concentration sufficient to provide at least about 500 ppm of the heavy duty liquid detergent in the solution and at least about 2500 ppm of the polymer in the solution has a turbidity of about 10 or less.

2. The detergent composition of claim 1, wherein the PMAOVE hydrophobically modified polymer comprises monomers of structure:

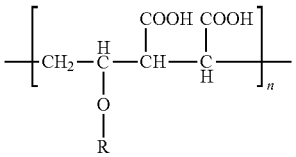

wherein R is an octyl chain.

3. The detergent composition of claim 1, wherein the heavy duty liquid detergent comprises one or more surfactants and one or more polymers.

4. The detergent composition of claim 1, wherein the PMAOVE comprises about 1-10 wt % of the detergent composition.

5. The detergent composition of claim 1, wherein the PMAOVE comprises about 5-25 wt % of the detergent composition.

6. The detergent composition of claim 1, wherein the PMAOVE comprises about 25-75 wt % of the detergent composition.

7. The detergent composition of claim 1, wherein the PMAOVE comprises about 60-99 wt % of the detergent composition.

8. The detergent composition of claim 1, wherein the detergent composition is such that an aqueous solution comprising 1 g/L of substantially unaged oleic acid and having a detergent composition concentration sufficient to provide at least about 500 ppm of the heavy duty liquid detergent in the solution and at least about 2500 ppm of the polymer in the solution has a turbidity that is equal to or less than about 42% of the turbidity in a corresponding solution comprising 1 g/L of substantially unaged oleic acid and having about 0 ppm of the polymer and about 5000 ppm of the heavy duty liquid detergent.

9. The detergent composition of claim 1, wherein the detergent composition is such that an aqueous solution comprising 1 g/L of substantially unaged oleic acid and having a detergent composition concentration sufficient to provide at least about 500 ppm of the heavy duty liquid detergent in the solution and about 2500 ppm of the polymer in the solution has a turbidity that is equal to or less than about 56% of the turbidity in a corresponding solution comprising 1 g/L of substantially unaged oleic acid and having about 0 ppm of the heavy duty liquid detergent and about 1000 ppm of the polymer.

10. A method of cleaning a substrate, comprising:

contacting a substrate with a detergent composition comprising poly(maleic acid/vinyl octyl ether) (PMAOVE) hydrophobically modified polymer solution; and a heavy duty liquid detergent;

wherein the contacting is sufficient to at least partially remove one or more stains, and wherein the detergent composition is such that an aqueous solution comprising 1 g/L of substantially unaged oleic acid having a detergent composition concentration sufficient to provide at least about 500 ppm of the heavy duty liquid detergent in the solution and at least about 2500 ppm of the polymer in the solution has a turbidity of about 10 or less.

11. The method of claim 10, further comprising agitating the substrate in contact with the detergent composition.

12. The method of claim 11, wherein agitating comprises one or more of shaking, mixing, spinning, rotating, vibrating or pressing.

13. The method of claim 10, wherein contacting comprises pressing using a pre-spotter apparatus.

14. A detergent composition, comprising:

a poly(maleic acid/vinyl octyl ether) (PMAOVE) hydrophobically modified polymer, comprising monomers of the structure:

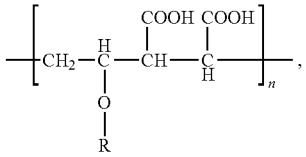

wherein R is an octyl chain; and, a heavy duty liquid detergent;

wherein the detergent composition is such that an aqueous solution comprising 1 g/L of substantially unaged oleic acid and having a detergent composition concentration sufficient to provide at least about 500 ppm of the heavy duty liquid detergent in the solution and at least about 2500 ppm of the polymer in the solution has a turbidity of about 10 or less.

* * * * *